US009496611B2

(12) United States Patent
Vagman

(10) Patent No.: US 9,496,611 B2
(45) Date of Patent: Nov. 15, 2016

(54) SYSTEM AND METHOD FOR COHERENT PROCESSING OF SIGNALS OF A PLURALITY OF PHASED ARRAYS

(71) Applicant: ELTA SYSTEMS LTD., Ashdod (IL)

(72) Inventor: Yacov Vagman, Rishon LeZion (IL)

(73) Assignee: ELTA SYSTEMS LTD., Ashdod (IL)

( * ) Notice: Subject to any disclaimer, the term of this patent is extended or adjusted under 35 U.S.C. 154(b) by 0 days.

(21) Appl. No.: 14/646,992

(22) PCT Filed: Nov. 25, 2013

(86) PCT No.: PCT/IL2013/050967

§ 371 (c)(1),
(2) Date: May 22, 2015

(87) PCT Pub. No.: WO2014/091475

PCT Pub. Date: Jun. 19, 2014

(65) Prior Publication Data

US 2015/0325913 A1 Nov. 12, 2015

(30) Foreign Application Priority Data

Dec. 13, 2012 (IL) ..... 223619

(51) Int. Cl.

| | |
|---|---|
| ***H01Q 3/00*** | (2006.01) |
| ***H01Q 3/34*** | (2006.01) |
| ***H01Q 3/26*** | (2006.01) |
| ***H01Q 21/29*** | (2006.01) |

(Continued)

(52) U.S. Cl.

CPC ..... *H01Q 3/34* (2013.01); *H01Q 3/2605* (2013.01); *H01Q 21/296* (2013.01); *H01Q 25/00* (2013.01); *H04R 3/005* (2013.01)

(58) Field of Classification Search

CPC ..... H01Q 3/26; H01Q 3/36
USPC ..... 342/81, 368, 372, 373; 381/94.3; 455/562.1

See application file for complete search history.

(56) References Cited

U.S. PATENT DOCUMENTS

| | | | |
|---|---|---|---|
| 4,752,969 | A | 6/1988 | Rilling |
| 5,565,873 | A | 10/1996 | Dean |
| 6,246,369 | B1 | 6/2001 | Brown et al. |

(Continued)

OTHER PUBLICATIONS

International Search Report for International Application No. PCT/IL2013/50967, mailed Mar. 28, 2014.

(Continued)

*Primary Examiner* — Dao Phan
(74) *Attorney, Agent, or Firm* — Dorsey & Whitney LLP

(57) ABSTRACT

Systems and methods for utilizing two or more phased arrays to coherently receive and/or transmit waveforms to one or more directions. The method includes applying a first and a second coherent processing to two or more sets of signal portions received or transmitted by corresponding two or more phased arrays. In reception mode, the first coherent processing includes converting the sets of signal portions received into corresponding sets of directional signals, by applying coherent integrations to each set signals portions such that each of the resulting directional signals being indicative of the angular frequencies, amplitudes and phases of the received waveforms. In reception mode, the second coherent processing includes adjusting phases of respectively the sets of the directional signals according to spatial dispositions between their respective phased arrays and the angular frequencies of the directional signals, thereby generating a coherent set of directional signals.

24 Claims, 6 Drawing Sheets

(51) Int. Cl.
*H01Q 25/00* (2006.01)
*H04R 3/00* (2006.01)

(56) References Cited

U.S. PATENT DOCUMENTS 6,718,184 B1 4/2004 Aiken et al.
6,784,831 B1 8/2004 Wang et al.
7,369,833 B2 5/2008 Smith
7,864,106 B2 1/2011 Beilin et al.
8,022,874 B2 9/2011 Frieaizen
2002/0080360 A1 6/2002 Bablumyan et al.
2007/0285315 A1 12/2007 Davis et al.
2010/0328157 A1 12/2010 Culkin et al.
2012/0140946 A1 6/2012 Yen et al.

OTHER PUBLICATIONS

European Search Report for European App. No. 13863504 (PCT/IL2013/050967) mailed Jun. 24, 2016.

SYSTEM AND METHOD FOR COHERENT PROCESSING OF SIGNALS OF A PLURALITY OF PHASED ARRAYS

TECHNOLOGICAL FIELD

This invention relates to a method and system for processing signals received or transmitted by multiple arrays of receiving and/or transmitting elements. Specifically the invention enables to apply coherent processing to signals to be transmitted or received by two or more phased array antennas.

BACKGROUND

Phased arrays of antenna elements are generally widely used to control the direction and angular gain dependence of a beam for a waveform to be transmitted or received. In general, the larger the extent of a phased array arrangement, the narrower the beam that can be formed thereby, and thus the better is its directional accuracy and gain in the main beam direction. Also, the minimal wavelength $\lambda_{min}$ of radiation which can be optimally received and/or transmitted by a phased array arrangement depends on the spacing d between the elements of the phased array arrangement as follows $\lambda_{min}=2d$. Specifically, the smaller the spacing d between the plurality of receiving/transmitting elements of a phased array, the shorter the wavelengths $\lambda$ ($\lambda>\lambda_{min}=2d$) which may be received/transmitted by the phased array with optimal directional resolution while avoiding/reducing directional ambiguity.

One technique for processing signals from phased arrays is disclosed for example in U.S. Pat. No. 8,022,874 co-assigned to the assignee of the present application. In this publication a respective electromagnetic parameter and spatial disposition of an unknown number of signal sources in a surveillance space simultaneously bombarded by multiple signals are determined by receiving multiple signals at each of a plurality of widebeam, wideband antennas equally spaced apart in a linear array. Respective antenna signals are simultaneously sampled to generate a two-dimensional array of values. A two-dimensional Fourier transform is computed whose peaks satisfy one or more predetermined criteria, each peak being indicative of a signal source in the surveillance space, whereby the location of the peak in the Fourier transform indicates the frequency and the azimuth of the respective signal source and the amplitude of the peak indicates the amplitude of the signal source. When implemented using two mutually perpendicular unified linear arrays (2D-ULA) or 2D (planar) array of receiving antennas, an additional Fourier transform of the two-dimensional Fourier transform generates, for each identified emitter, independent azimuth and elevation angles.

Also, U.S. Pat. No. 7,369,833 discloses a receive system providing enhanced directivity in the form of a narrowed receive beam and a relatively small antenna with performance comparable to a much larger antenna at similar frequencies. Received signals are converted to digital values and stored in a manner which enables subsequent processing directed to improving the resolution of the received signals and to reduce the associated noise corresponding to the received data samples. The Signal-to-Noise ratio of the received data signals is improved as a result of processing techniques made possible by the configuration of the antenna and the digitally stored nature of the received data.

U.S. Pat. No. 5,565,873 provides an antenna for a base station comprising a plurality of antenna arrays each capable of forming a multiplicity of separate overlapping narrow beams in azimuth, the arrays being positioned such that the beams formed by the arrays provide a coverage in azimuth wider than each array. Means are provided for operating two or more non-collocated narrow beamwidth antenna arrays to form jointly a broad beamwidth antenna radiation pattern wherein the time averaged antenna pattern is substantially null free.

General Description

There is a need in the art for a novel technique for processing signals to be communicated (transmitted and or received) via a plurality of two or more phased array arrangements of signal communication elements (e.g. signal transmitters and/or receivers).

Known in the art techniques for combining the signal received by the plurality of phased arrays typically rely on independent and separate beam forming of the signals obtained by each of the arrays and on non-coherent analysis and/or combination of the beam formed signals obtained by the distinct phased array arrangements. In this regard the amplitude/powers of the signals from the distinct phased arrays are combined together (e.g. by mathematical or statistical tools) with disregard to the phases at which those signals were received by different phased arrays. This generally results in relatively poor directional accuracy and resolution as well as reduced signal to noise ratio (SNR) as compared with those achievable considering coherent processing of the signals obtained from all the elements of the distinct phased array arrangements. Considering a transmission channel/path utilizing a plurality of phased arrays, non coherent signal transmission by the different phased array arrangements may result in reduced transmission power to the desired direction and poor directional accuracy and resolution as compared to those achievable when coherent transmission is achieved (e.g. when utilizing a single larger phased array arrangement, instead of a plurality of smaller ones). Thus, indeed from both transmission and reception point of view, the existing techniques for communicating signals by multiple phased arrays provide poorer results than those provided when the same signals are communicated by a single phased array of comparable size and number of elements.

However, in many cases it is desirable to utilize a plurality of (two or more) phased arrays instead of a single larger one. In some cases the required space for accommodating single continuous phased array is lacking while it is possible to accommodate several spaced apart arrays with spatial disposition between them. For example, in cases where phased arrays of communication elements such as phased array antennas are to be mounted on a movable platform such as an aircraft, it may be possible to install only multiple smaller phased arrays and not a single larger one. In this regard the present invention may be used, for example, in surveillance and tracking radar, in passive systems used for intercepting signals (e.g. radar systems operating in passive modes), and in an ultrasound system.

The present invention provides a technique for coherent processing of signals of a plurality of phased array arrangements providing improved SNR, accuracy and directional resolution which is comparable, and in some aspects better than, that provided by processing signals of a single phased array. In this regard it should be noted here that the term phased array should be considered as an arrangement of signal communicating elements/utilities (e.g. antenna elements) arranged substantially along a one or two dimensional line/surface which may be planar or curved to some extent. Typically, in a phased array, the phase of each element can be set independently. Also, the curvature of curved phased arrays is typically configured such that at least some elements of the array share a common, overlapping, angular coverage and similar polarizations. The communicating elements/utilities may be receiving, transmitting and/or transceiving elements and according to various embodiments of the present invention they may be configured and operable to operate with various different types of waveform signals transmitted thereby, for example to receive and/or transmit electro-magnetic (EM) signals at various desired frequencies and/or acoustic waveform signals (e.g. ultra-sound US signals) or other waveform signals. In this connection, the terms receiving, transmitting, transceiving and/or communicating, are used herein interchangeably to indicate any one or both of the operations of transmitting and or receiving waveform signals. The terms element(s) and specifically transmitting/receiving/transceiving elements are used herein to generally denote modules such as antennas, sensors and/or transducer elements capable of sensing/receiving and/or transmitting waveforms in any of the electro-magnetic and/or acoustic domains and possibly also in other domains. Also, the term antenna elements should be considered herein to include an EM antenna and/or other types of communication/radiation receiving and/or transmitting elements such as acoustic (e.g. US) transducers.

In this connection it is noted that the communicating/transceiving element may be an antenna element/utility and/or acoustic transducer (receiver and/or transmitter) and/or any other type of transmission and/or reception utility that is adapted for either converting an input signal, which is inputted thereto, into a corresponding waveform transmitted from a communicating/transceiving element, and/or for converting a radiated/propagated waveform signal into an corresponding output signal.

It should be understood that the terms input/output signals (also referred to herein below simply by signals) may be electrical signals, optical signals and may be implemented analogically or digitally. In this connection, as will be further described below, the system of the invention may be implemented digitally or analogically and accordingly the term signals is meant to cover both the digital data/samples which may be stored for example in digital memory and also to cover the analogue signals such as electric signals which in their amplitudes and phases may encapsulate data. To this end, the terms signal and signals should be read also as data and/or as information where appropriate.

Thus, the present invention provides a system and a method for identifying incoming signals captured by a set of phased arrays (PA; e.g. phased array antennas or ultrasonic phased arrays) with improved Signal to Noise Ratio (SNR). Specifically, the invention provides a technique for combining signals obtained on each of the PAs to determine/detect the direction(s) of arrival of the incoming signals while improving the SNR and/or accuracy of the detection. In addition, the present invention provides a system and a method for transmitting a waveform signal/radiation by utilizing a set of two or more PAs with improved directional resolution and reduced directional ambiguity (e.g. reduced side lobes) in the transmitted waveform. Specifically, the invention provides a technique for determining coherent signals to be transmitted by each of the PAs for forming the desired waveform by the collective transmission of those signals from the two or more PAs, thus exploiting the multiple PAs for improving the directional resolution and accuracy of the transmitted waveform, and reducing the directional ambiguity of the transmission.

The phased arrays (e.g. antenna arrays) are generally arranged spaced apart from one another with arbitrary distances/dispositions between them. The phased arrays may be arranged with a co-planar relationship between them on a common plane, or alternatively or additionally the positions and/or orientations of some of the phased arrays may deviate from a common plane. In the latter case, the technique of the present invention may be applied to an angular domain which is common to some or all phased arrays to coherently process (e.g. combine/derive) signals received/transmitted in this angular domain.

In this connection it should be understood that the terms coherent processing, coherent-integration/combination and coherent-derivation are used herein to indicate signal processing in which phase information is maintained and adjusted appropriately while receiving/transmitting signals by a plurality of spaced apart communicating-elements such as antenna elements. Specifically, the phases of signals received/transmitted in a certain direction and wavelength by spatially disposed elements are affected by phase shifts incurred due to the spatial disposition between the transmitting/receiving elements (e.g. antenna/transducer/sensor elements). Accordingly, in coherent processing of such signals, the phases of the signals, which are received or which are to be transmitted, are adjusted to compensate for such phase-shifts. This provides that the signals transmitted/received by the spaced apart elements constructively interfere in the desired direction of propagation thus improving the power/gain of the signals in this direction.

The invention also allows unambiguous measurement of the direction of the incoming signals even in cases where the antennas or some of them produce only ambiguous directions. For example, in accordance with the sampling theorem (i.e. Nyquist theorem) in cases where the distance between antenna elements of an antenna array is greater than half the wavelength of the incoming signal to be detected thereby, an aliasing effect would occur, allowing only ambiguous detection of the direction of the incoming signal. The present invention, according to some aspects thereof, resolves this ambiguity by providing a technique to process the signals received from several antenna arrays, at least some of which are associated with different spatial Nyquist frequencies (e.g. different distances between antenna elements of different arrays). To this end, spacing of antenna elements may vary from one array to another and it may even violate the limitation of half of the wavelength which is necessary to prevent the appearance of grating lobes on each single antenna.

In addition, the composite transmission and/or reception system according to the present invention includes an arrangement of multiple phased arrays whose combined spatial extend/size may be substantially larger than the size/extension of a single phased array of comparable number of elements with similar spacings between them. Therefore accordingly, the angular beam associated with the composite transmission and/or reception system is narrower, compared to the beam produced by such a single phased array. To this end, the narrower beam provides better angular resolution and hence higher directional accuracy and angular measurement may be obtained, provided some extra processing is carried out. An exemplary implementation of such extra processing could be a mono-pulse procedure based on the composite delta patterns (i.e. 4 patterns), in which neighboring beams are used to interpolate a desired angular spectrum and thus obtain angular accuracy which is better than the beamwidth. Additionally, narrowing the beam is equivalent to higher gain of the composite transmission and/or reception system which is therefore associated with an increase/improvement in the SNR as mentioned above.

It should be understood that the invention may be implemented for improving the accuracy of reception and transmission of both sigma and delta radiation patterns (sigma and delta channels). A sigma channel/pattern is used herein to indicate a radiation-pattern/beam having its main lobe (ML) steered in the direction of the boresight of the phased array (i.e. substantially perpendicular to the phased array). A delta channel/radiation-pattern is used herein to indicate a beam with its ML steered to endfire of the phased array with respect to the azimuth and elevation (i.e. substantially parallel to the phased array), or more accurately a beam that has a null at the boresight of the array.

Thus according to a broad aspect of the present invention there is provided a signal processing method including:

i. applying a first coherent processing to two or more signal sets comprising signal portions being received or transmitted by corresponding two or more phased arrays operating in respective receiving or transmitting modes. The first coherent processing includes converting the sets of signal portions being received into corresponding sets of directional signals or converting sets of directional signals into the sets of signal portions to be transmitted. The conversion includes coherent integrations of each set of signal portions in reception and/or of directional signals in transmission, for obtaining the other one of the sets (obtaining the sets of directional signals in reception and the sets of signal portions in transmission mode). Each of the directional signals is indicative of the angular frequencies (directions), amplitudes and phases of waveforms to be received or transmitted.

ii. applying a second coherent processing to a coherent set of directional signals or to said two or more sets of the directional signals to perform the respective transmitting and receiving modes. The second coherent processing of the transmitting and receiving modes includes adjusting phases of respectively the coherent set of directional signals (in transmission) and the sets of the directional signals (in reception) wherein the phases are adjusted in accordance with spatial dispositions between the PAs and the angular frequencies of the directional signals. The phase adjusting in the transmitting and receiving modes provides respectively the sets of the directional signals and the coherent set of directional signals.

The technique of the invention thereby enables to utilize two or more PAs to carry out at least one of coherently receiving and coherently transmitting signals/waveforms propagating in one or more directions with improved gain and typically with improved angular resolution and SNR.

It should be understood that the term first coherent processing relates to the coherent processing of signals to be transmitted/received by the elements of each individual PA (e.g. independently from processing of signals of other PAs). Accordingly this term may be understood as relating to PA specific coherent processing which is adapted to properly and coherently adjust phase signals associated with the elements of a specific PA in accordance with the respective locations of the elements. The term second coherent processing relates to a collective coherent processing of signals associated with the plurality of PAs to adjust their phases in accordance with the respective locations of the different PAs. In this connection it should be understood that the terms first and second do not necessarily indicate the temporal order of the processing. For example, in reception mode of operation the first processing may precede the second processing and vice versa in transmission mode.

According to some embodiments, the method of the invention is configured for operating in receiving mode for determining one or more directions of propagation of an incoming waveform received by the arrangement of two or more PAs. The method includes: simultaneously receiving incoming waveform by the two or more PAs and generating two or more sets of signal portions corresponding to the incoming waveform respectively received by the two or more phased arrays [PAs]. The first coherent processing includes applying coherent integration to each of the two or more sets of signal portions for a given wavelength to obtain the two or more corresponding sets of directional signals. The second coherent processing includes adjusting the phases of the directional signals in the sets of directional signals in order to compensate over the spatial dispositions between the PAs and thereby determine two or more phase adjusted sets of directional signals corresponding to the two or more PAs. The second coherent processing in the reception mode also includes coherently adding corresponding directional signals which are associated with similar angular frequencies in the two or more phase adjusted sets of directional signals to thereby determine one or more composite directional signals presenting the coherent set of directional signals. Each composite directional signal is indicative of an amplitude by which an incoming waveform with a particular angular frequency was received by the two or more PAs. The method thereby enables to utilize two or more PAs for determining one or more directions of propagation of incoming waveforms with improved signal to noise ratio and improved angular resolution.

According to some embodiments in which the method is configured for operating in receiving mode, the method further includes comparing the composite directional signals with a predetermined criteria to determine, for at least one composite directional signal, whether it is indicative of an actual incoming waveform propagating from a particular direction corresponding to the angular frequency thereof, or whether it is a noise signal. Specifically, in some cases, the comparison includes determining a power of the at least one composite directional signal and comparing the power with a predetermined threshold.

According to some embodiments, the method of the invention is configured for operating in transmitting mode for determining two or more sets of signal portions to be transmitted respectively by the elements of the two or more PAs for generating transmitted waveforms propagating in one or more desired directions. The method includes providing the coherent set of directional signals in which each directional signal is indicative of an amplitude and particular direction towards which a waveform signal should be transmitted by the two or more PAs, and applying thereto the second coherent processing, which, in this case includes applying phase adjustment to directional signals in two or more replicas of the coherent set of directional signals for respectively generating the two or more sets of directional signals from the two or more replicas. The phase adjustment is adapted to correct the phases of the directional signals of each particular set of directional signals in accordance with spatial disposition of the PA respectively associated with the particular set of directional signals. The first coherent processing includes applying coherent integration to each of the two or more sets of directional signals for respectively generating, for a given transmission wavelength, the two or more sets of signal portions and simultaneously providing the sets of signals portions to the elements of the respective PAs for transmitting the transmitted waveform towards the one or more desired directions of propagation with improved angular resolution and reduced sidelobes.

According to some embodiments of the invention the one or more of said PAs are configured as curved PAs, each including an array of elements arranged along a curved surface or line. For example, the curved PAs may be installed on a surface of a platform/vessel such as a vehicle, airplane and/or ship.

According to some embodiments of the invention the elements of at least one PA are arranged in uniform spatial disposition defining fixed distances between them with respect to at least one axis. For example, the elements of the same PA are arranged on said at least axis and/or on at least some of the elements of the at least one PA are spaced from the axis, and the fixed distance being a distance between projections of the elements onto the axis.

According to some embodiments, the fixed distance between the elements of at least one PA is different from a fixed distance between the elements of the other PA of the two or more PAs, such that the sets of directional signals associated with the at least one PA and said other PA include signals from different groups of angular frequency bins. In such cases the method may further include interpolation of directional signals carried out in at least one of the following:

(i) in receiving operational mode, the interpolation includes interpolating at least one set of the two or more sets of directional signals to thereby obtain, in the two or more sets of directional signals, directional signals indicative of the amplitudes and phases with respect to a common group of angular frequency bins with improved directional resolution;

(ii) in transmitting operational mode, the interpolation includes interpolating at least one set of two or more sets of directional signals, which are associated with a common group of angular frequency bins resulting from the second coherent processing. To this end, the sets of directional signals obtained, are associated with different groups of angular frequency bins set in accordance with the fixed distance between the elements of their respective PAs.

In some cases the interpolation is at least partially performed together with the first coherent processing. For example the first coherent processing and the interpolation may be performed together utilizing the zero-padding fast-Fourier-transform algorithm. Also, in some cases the interpolation of at least one set of directional signals includes re-sampling the directional signals of the set.

According to some embodiments of the invention the fixed distances of the uniform spatial disposition between the elements of at least one PA are greater than half the wavelength (e.g. to be received and/or transmitted). Accordingly, the set of directional signals, corresponding to that PA (i.e. associated with the first coherent processing of signals of that PA), is a folded set that is associated with directional ambiguity. In such cases the method of the invention includes converting between the folded set and an unfolded set of directional signals. The unfolded set is expressly indicative of the directional ambiguity (e.g. the aliased bins appear therein). Accordingly, the method includes utilizing the unfolded set of directional signals in the second coherent processing (e.g. instead of the folded set).

According to some embodiments at least one PA is not aligned with the other PAs. In such cases the method includes modifying at least one set of signal portions corresponding to the least one PA by co-phasing them to compensate for the misalignment. To this end, the unaligned PA(s) may be a two dimensional PA not co-planarly aligned with the other PAs, and/or a one dimensional PA not collinearly aligned with the other PAs, and/or a curved PA. In this regard the co-phasing may be configured and operable for respectively compensating over a corresponding one of a coplanar- and collinear-misalignment and a curvature of the misaligned PA(s).

According to some embodiments of the present invention the first coherent processing is performed by applying a Fourier transform, based on said given wavelength, to convert between the two or more sets of signal portions and the two or more corresponding sets of directional signals. The Fourier transform may include weighting factors for suppressing sidelobes. The Fourier transform may be applied utilizing any one of: Discrete Fourier transform (DFT), Fast Fourier transform (FFT) and/or other techniques (e.g. zero-padding FT).

According to some embodiments of the present invention, in said second coherent processing, the phase of a directional signal associated with particular PA is shifted by an amount corresponding to the phase delays incurred to a waveform signal, which is received by the PA. The incurred phase delays correspond to the angular frequency associated with the directional signal and disposition between the particular PA and other PAs.

According to some embodiments of the present invention, the coherent set of directional signals is associated with a delta pattern received or transmitted by said arrangement of two or more PAs.

According to a broad aspect of the present invention there is provided a computer program product comprising a computer readable physical medium having computer readable program code embodied therein and adapted for causing the computer to carry out the method operations described above and/or further below with respect to one or more embodiments of the invention.

According to yet another a broad aspect of the present invention there is provided a signal processing system including a signal processing utility connectable to the elements of two or more PAs and configured for operating in at least one of receiving and transmitting modes for applying signal processing to signals respectively received or transmitted by the elements of the two or more PAs. The signal processing includes the operations of the method described above, and as described in more details further below, with respect to any one of the reception and transmission modes or both. Specifically according to some embodiments of the present invention the signal processing utility includes a PA coherent processing module (also termed herein the following as PA coherent integration module) that is adapted for applying the first coherent processing operation, and a composite coherent processing module (also termed herein the following as composite coherent integration module) that is adapted for applying the second coherent processing operation.

According to some embodiments of the present invention the system is configured for operating in receiving mode for determining one or more directions of propagation of an incoming waveform received by the arrangement of two or more PAs. The processing utility is adapted to receive the two or more sets of signal portions of incoming signals which are simultaneously received by the two or more PAs respectively. The PA coherent integration module is adapted for applying a first coherent integration to each of the two or more sets of signal portions based on a given wavelength to thereby obtain two or more corresponding sets of directional signals. The composite coherent processing module is adapted for applying the second coherent processing to the two or more sets of the directional signals. The second coherent processing includes adjusting the phases of the directional signals in the sets of directional signals in order to compensate over the spatial dispositions between the PAs and thereby determine two or more phase adjusted sets of directional signals corresponding to the two or more PAs. Then the composite coherent processing module coherently adds one or more corresponding directional signals associated with similar angular frequencies in the two or more phase adjusted sets of directional signals and thereby determines one or more composite directional signals presenting the coherent set of directional signals. Each composite directional signal is indicative of an amplitude by which an incoming waveform with a particular angular frequency was received by the two or more PAs. The system may thereby be configured for determining one or more directions of propagation of the incoming waveform with improved gain, improved signal to noise ratio, and/or improved angular frequency resolution.

According to some embodiments of the present invention the system is configured for operating in transmitting mode for determining two or more sets of signal portions to be respectively transmitted by the elements of the two or more PAs for generating transmitted waveform signals propagating in one or more desired directions. The processing utility is adapted to obtain the coherent set of directional signals in which each signal is indicative of an amplitude and particular direction towards which a waveform signal should be transmitted by the two or more PAs. The composite coherent processing module is adapted for applying the second coherent processing by applying phase adjustment to directional signals in two or more replicas of said coherent set of directional signals for respectively generating said two or more sets of directional signals from said two or more replicas. The phase adjustment is adapted to correct the phases of the directional signals of each particular set of directional signals in accordance with spatial disposition of the PA that is respectively associated with the particular set of directional signals. The coherent integration module is adapted for applying the first coherent processing by applying coherent integration to each of the two or more sets of directional signals for respectively generating, for a given transmission wavelength, the two or more sets of signal portions. The processing utility is adapted to simultaneously provide the sets of signal portions to the elements of the respective PAs for causing transmission of the waveform signals towards the one or more desired directions of propagation with improved angular resolution and reduced side-lobes.

In some cases the coherent integration module is also adapted for comparing the composite directional signals with one or more predetermined criteria to determine, for at least one composite directional signal, whether it is indicative of an actual incoming waveform propagating from a particular direction corresponding to the angular frequency of the directional signal or whether it is a noise signal. In this regard the criteria may be for example an SNR threshold, a signal vs. low-power signals criteria, criteria distinguishing side-lobes from main lobe signals, and/or other criteria. The comparison may for example include determining a power of at least one composite directional signal and comparing the power with a predetermined threshold.

According to some embodiments the system may include the two or more PAs. One or more of the PAs may be configured as curved PAs, each including an array of elements arranged along a curved surface or line. In some cases at least one PA is associated with a uniform spatial disposition of its elements which is defined by a fixed distance between the elements along/with respect to at least one axis. The elements may be arranged on the at least axis of the PA and/or spaced from the at least axis. In the latter case the fixed distance is a distance between projections of the elements' locations onto the axis.

In some embodiments the PAs are fixedly located and oriented with respect to one other. In such cases, one or more of the method operations may be performed based on pre-processing operations. This for example may be achieved by utilizing a steering matrix as that of Eq. 11 below (e.g. presenting the first and second coherent processing together) which is pre-calculated in advance) and/or utilizing predetermined configuration hardwired analogue/digital signal processing modules. Alternatively or additionally, in some embodiments one or more of the PAs may be movable/rotatable with respect to other PAs. In such cases the system of the invention may be configured to operate dynamically and in real time in order to coherently process the signals of the PAs (including those associated with fixed PAs and those associated with movable/rotatable PAs). For example, the steering matrix of Eq. 11 below may be calculated and/or at least partially calculated in real time in accordance with the concurrent respective positions and/or orientations of the movable PAs.

As noted above the fixed distance between the elements of one PA may be different from a fixed distance between the elements of another PA and accordingly, the directional signals of different PAs may be associated with different angular frequency bins. In such cases, in receiving and/or transmitting modes, the processing utility may also operate for interpolating directional signals of one or more PAs. In some cases the PA coherent integration module may be configured and operable for performing the interpolation together with the first coherent integration (e.g. utilizing the zero-padding fast-Fourier-transform).

In cases where the fixed distance between the elements of a PA is greater than half the received/transmitted wavelength, directional ambiguity may occur due to aliasing presented in a folded set of directional signals. The processing utility may be adapted resolving the directional ambiguity by converting between the folded set(s) and unfolded set(s) in which the aliasing is expressly apparent (i.e. in which additional bins represent the aliased-directions/directional-ambiguity) and then utilizing the unfolded set(s) for performing the second coherent processing by the composite coherent integration module.

According to some embodiments of the present invention the at least one PA may not be aligned with respect to the other PAs. The processing utility may in such cases include a phase alignment module that is configured and operable for modifying at least one set of signal portions to be respectively received/transmitted by elements of the misaligned PA(s) and to co-phasing the signal portions for compensating the misalignment. Specifically the PA(s) may be not co-planarly/collinearly aligned, and/or may include curved PA(s). The phase alignment module may be capable of compensating for such PAs.

It should be noted that the processing utility may be configured with analog signal processing means and/or with digital signal processing means and may be configured for carrying out the processing digitally, analogically and/or by and a combination of analogue and digital signal processing. Also, the PA coherent processing module, the composite coherent processing module, and possibly also additional modules may be configured as a single module that is adapted for performing both first and second coherent processing together, and possibly also additional processing operations as such may be needed according to various embodiments of the present invention. In this regard, mathematical presentations of signal processing operations, which may be carried out by a single module or distributed in several modules, is provided for example in equations 11 to 15 below.

Is should be noted here that the term 'signals' is broadly used herein in various contexts, for example for denoting electrical signals, as well as for denoting data pieces which are stored and/or processed by analog or digital means. In addition, this term is also used herein to denote waveform/radiation signals such as electromagnetic radiation. It should also be understood that the term 'angular frequency' of a signal/waveform indicates the direction of propagation of the waveform and is associated with the angle of arrival/transmittance of the waveform and with its frequency.

As noted above, the terms 'first and second coherent processing' are not used to denote the specific orders by which such processing is carried out. In this regard, in various implementations of the present invention, such first and second coherent processing, and possibly, together with other signal processing stages, may be combined to a signal processing operation which may also be carried out by a single signal processing module. For example, as would be readily appreciated from the description below, the first and second coherent processing may be represented by a single steering matrix whose mathematical operation may be implemented utilizing a single analogue or digital signal processing module/circuit. To this end, the PA coherent processing module and the composite coherent processing module, as well as other modules of the system of the present invention, may also be combined together in a single signals processing module.

BRIEF DESCRIPTION OF THE DRAWINGS

In order to understand the disclosure and to see how it may be carried out in practice, embodiments will now be described, by way of non-limiting example only, with reference to the accompanying drawings, in which.

DETAILED DESCRIPTION OF EMBODIMENTS

In order to understand the invention and to see how it may be carried out in practice, a few preferred embodiments will now be described, by way of non-limiting examples only, with reference to the accompanying drawings and tables.

Figure 1A:
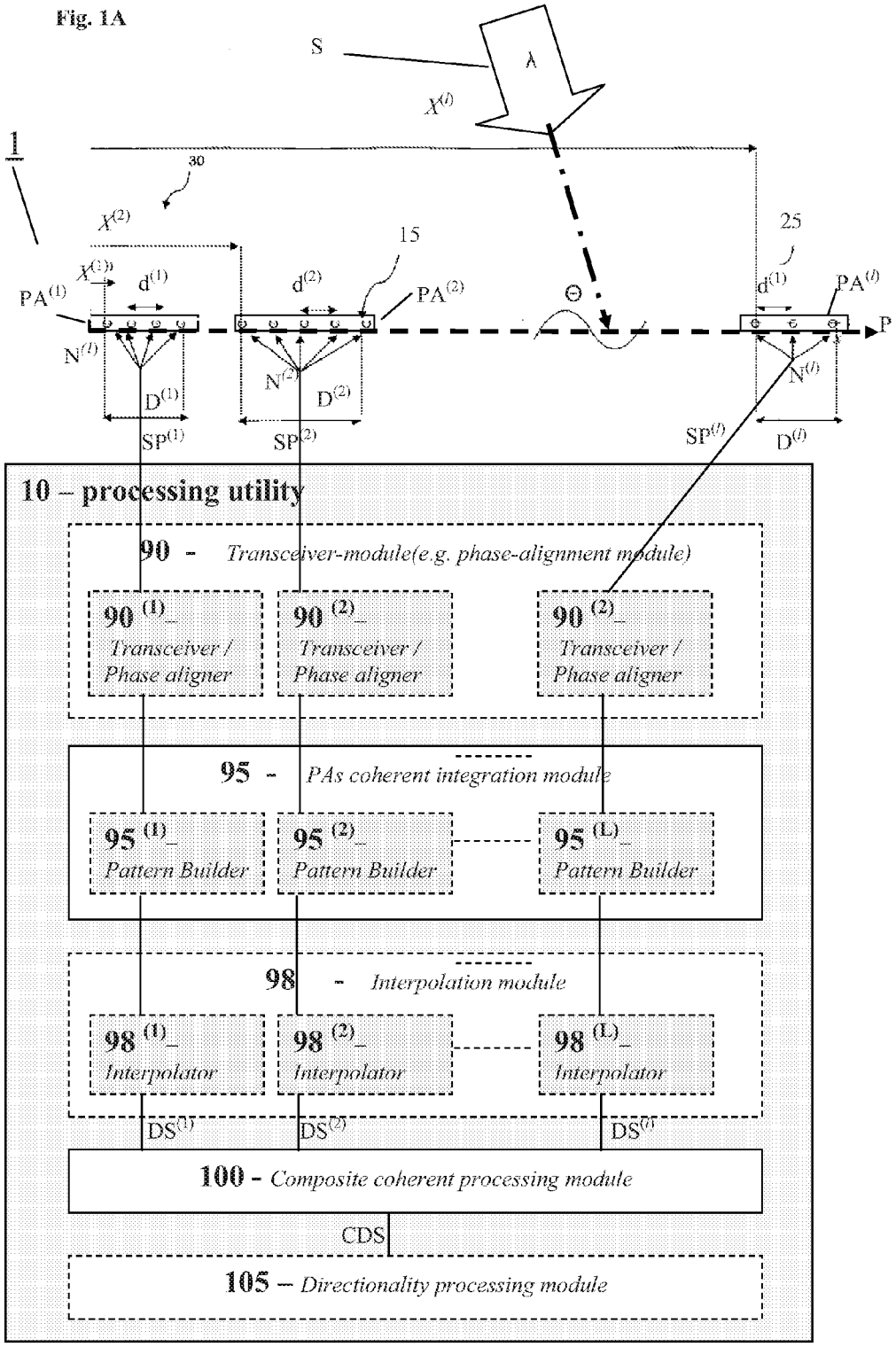
FIG. 1A is a schematic illustration of a system configured and operable according to the present invention for transmitting and/or receiving signals by multiple arrays 25 of transmitting and/or receiving elements (antenna/transducer/sensor elements)

Reference is made to FIG. 1A illustrating a transceiving system 1 which is configured and operable according to the present invention for transmitting and/or receiving signals by multiple arrays 25 of transceiving-elements 15 (e.g. antenna/transducer/sensor elements being transmitting and/or receiving elements). The system includes multiple arrays 25 of transceiving-elements 15 and a processing utility 10 (e.g. analogue, digital or a combination thereof) which is connectable to the transceiving-elements 15 via suitable analogue/digital circuitry. According to some aspects of the invention, the processing utility 10 is configured and operable for processing signal portions SP (e.g. sampled signals/data) that are concurrently received by receiving-elements 15 of the multiple arrays 25, which are indicative of signals S propagating in the vicinity of the transceiving-elements 15 and determine one or more directions of propagation of propagating signals S. Alternatively or additionally, according to some aspects of the invention, the processing utility 10 is configured and operable to determine signal portions SP to be fed to the transceiving-elements 15 of the multiple arrays 25 in order to transmit thereby the signals S towards a set of one or more predetermined directions.

As illustrated schematically in FIG. 1A, system 1 includes an arrangement 5 of phased arrays 25 (PAs; e.g. such as phased array antennas) each including an array of spaced apart transceiving-elements 15 that are configured and operable for transmitting and/or receiving signals of desired type such as electro-magnetic signals/waves/acoustic signals. The transceiving elements are represented in the figure by circles and are grouped per phased array 25. The transceiving-elements 15 of each PA are arranged in uniform spatial disposition along at least one axis of the PA (e.g. being equidistant from one another). The transceiving-elements may be for example antenna elements, ultra-sound transceivers or of other type of transmitting/receiving elements.

The present invention provides a coherent signal processing technique enabling to utilize multiple PAs to coherently transmit and/or receive signals from one or more particular directions. Conventional techniques for combining signals received by a plurality of PAs are generally non-coherent techniques which are based on combining the powers of signals which are received by different PAs, while ignoring the potentially different phases at which the signals from each particular direction were received by the different PAs. Such conventional techniques are thus associated with loss of phase information and therefore typically result in reduced accuracy and/or SNR compared to the results which are conventionally obtained when using a single PA which extends the same length as the multiple PAs and includes the same number of elements. In the same ways, conventional techniques for transmitting a signal to a certain direction by utilizing the multiple PAs, typically ignore the inter PA phase differences resulting from the different arrangement of the PAs and therefore also result in reduced accuracy and/or signal strength (e.g. as compared to transmitting the signal using a single PA as noted above). These problems are solved by the coherent signal processing methods of the present invention.

Figure 1B:
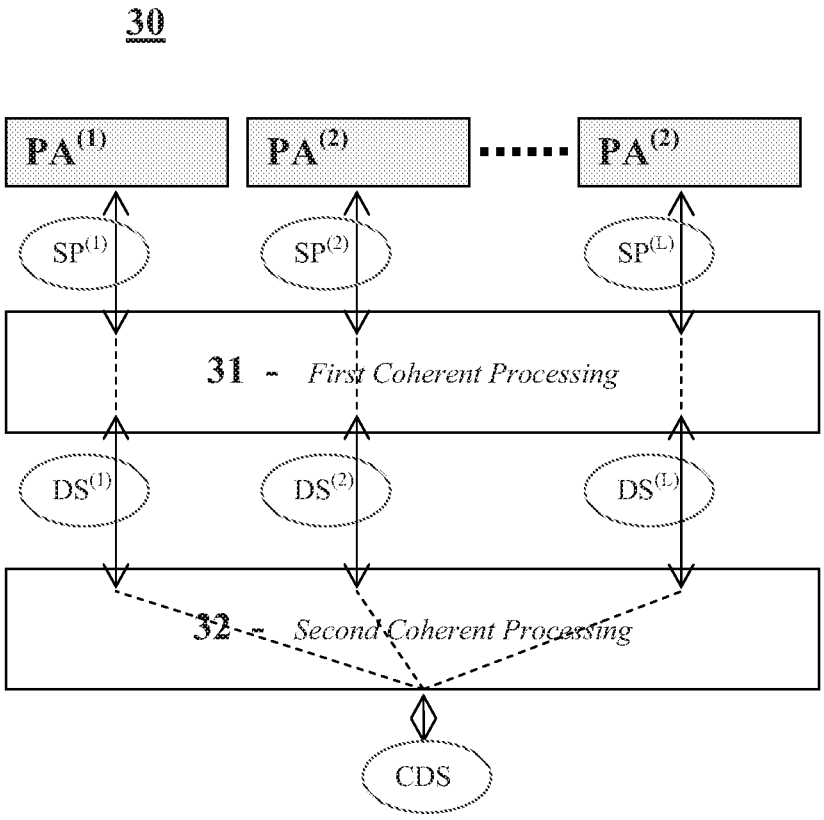
FIG. 1B is a flow diagram schematically illustrating a signal processing method according to the present invention.

FIG. 1B is a flow diagram illustrating a signal processing method 30 according to an embodiment of the present invention. Method 30 is adapted for converting between signal portions to be transmitted or received by the elements of the two or more PAs $PA^{(1)}$-$PA^{(L)}$ (i.e. transmitting and/or receiving elements) and a coherent set of directional signals CDS in which each directional signal is indicative of an angular frequency (e.g. directions), an amplitude and a phase of a waveform to be received or transmitted by the two or more PAs. Method 30 includes applying a first coherent processing to two or more signal sets $SP^{(1)}$-$SP^{(L)}$ which include signal portions being received or transmitted by the two or more phased arrays $PA^{(1)}$-$PA^{(L)}$ when these are respectively operating in respective receiving or transmitting modes. The first coherent processing comprises converting the sets of signal portions $SP^{(1)}$-$SP^{(L)}$ being received into corresponding sets $DS^{(1)}$-$DS^{(L)}$ of directional signals or converting sets $DS^{(1)}$-$DS^{(L)}$ of directional signals into the sets $SP^{(1)}$-$SP^{(L)}$ of signal portions to be transmitted. The conversion includes coherent integrations of each set in one of the sets of signals portions or the sets of directional signals for obtaining the other one of said sets of signals portions and said sets of directional signals. Each of the directional signals is indicative of the angular frequencies, amplitudes and phases of waveforms to be received or transmitted. Method 30 also includes applying second coherent processing to the coherent set CDS of directional signals (in transmission mode) or to the two or more sets $DS^{(1)}$-$DS^{(L)}$ of the directional signals (in receiving modes) to perform the respective transmitting and receiving modes. The second coherent processing of the transmitting and receiving modes includes adjusting phases of respectively the coherent set CDS of directional signals and the sets $DS^{(1)}$-$DS^{(L)}$ of the directional signals. The phases are adjusted in accordance with spatial dispositions between the PAs ($PA^{(1)}$-$PA^{(L)}$) and in accordance with the angular frequencies of the directional signals.

It should be noted that in receiving mode the first coherent processing typically precedes the second coherent processing, which is reversed in the transmitting mode of operation. Notwithstanding the above, it should be understood that the first and second coherent processing may be carried out together in a combined processing (e.g. performed substantially concurrently and/or by the same signal processing logic/circuit).

To this end, turning back to FIG. 1A, in order to better clarify the invention in the processing utility 10 depicted are a PA-coherent integration module 95 and a composite coherent processing module 100 in communication with one another via suitable circuitry/transmission lines. PA-coherent integration module 95 is adapted for carrying out the first coherent processing while the composite coherent processing module 100 is adapted for carrying out the second coherent processing. It should be understood that these modules 95 and 100 may be implemented practically as a single module/processing utility capable of carrying out together the first and second coherent processing.

The coherent integration module 95 is associated with a first signal input/output which is in communication with the transceiving elements 15 of the two or more PAs 25 and a second signal input/output which is in communication with the composite coherent processing module 100. The coherent integration module 95 is configured and operable for receiving as an input of one of said first and second signal input/output, two or more signal sets which are respectively associated with the two or more PAs 25 (e.g. which were received from the two or more PAs when the system is configured for the receiving operation, and/or which are to be processed and communicated to the PAs for transmission in case the system is configured for transmission operation). The coherent integration module 95 is adapted to separately and independently perform coherent integration (e.g. Fourier analysis) of each of the signal sets to obtain the two or more coherently integrated signals sets which are then outputted (e.g. towards the composite coherent integration module 100 in case of receiving configuration and/or towards the two or more PAs respectively in case of transmission configuration). In any case, the coherent integration is based on a given wavelength of a signal which is thought to be received/transmitted by the two or more PAs and on the respective geometrical properties of each $PA^{(1)}$ of the two or more PAs (e.g. distance $d^{(1)}$ between the transceiving elements 15 of the $PA^{(1)}$ and the number $N^{(1)}$ of elements 15 in $PA^{(1)}$ and the dimensions $D^{(1)}$ of the $PA^{(1)}$). In this regard it should be noted that the geometrical properties are generally a priori known configurational parameters of the system. The wavelength $\lambda$ is generally provided based on the wavelength of the signal thought to be transmitted and/or based on preliminary analysis (temporal/spectral analysis) of the wavelength(s) of signal S received by the PAs 25.

It should be noted that PAs coherent integration module 95 is depicted in FIG. 1A optionally including multiple independent pattern builders $\mathbf{95}^{(1)}$ to $\mathbf{95}^{(L)}$ which are respectively associated with the two or more PAs $PA^{(1)}$ to $PA^{(L)}$. Indeed, in some embodiments of the present invention the coherent integration of signals destined-to/received-by each PA is processed separately by an independent pattern builder module (one of $\mathbf{95}^{(1)}$ to $\mathbf{95}^{(L)}$). For example considering an analogue or digital system, a separate Fourier processing module (e.g. analogue arrangement of delay lines or digital processing unit) may be used for each PA independently. However, it should be understood that such configuration of the PAs coherent integration module 95 is not necessary. For example, considering a digital system, the sets of signal portions sampled by each of the PAs may be separately and independently processed sequentially by a single digital signal processing (DSP) utility.

Specifically, in embodiments in which the system is operative for receipt of signals by the two or more PAs, the PAs coherent integration module 95 is adapted for receiving two or more sets of signal portions $SP^{(1)}$ to $SP^{(L)}$ of incoming signals which are respectively simultaneously received (measured/sampled) in the spatial domain by said two or more PAs. Then, based on a given wavelength, coherent integration (also referred to herein below the first coherent integration—see method step 55 below) is independently applied to each of the two or more sets of signal portions (e.g. by means of direct Fourier transform (FT)) to convert the signal portions $SP^{(1)}$ to $SP^{(L)}$ in the spatial domain to obtain two or more corresponding sets of directional signals $DS^{(1)}$ to $DS^{(L)}$ indicative of the signal S in the frequency domain (i.e. in the spatial frequency domain). Namely indicative of the one or more directions from which the signal S is received by the two or more PAs. Generally, each set of directional signals includes one or more directional signals which are indicative of amplitudes and phases of incoming signals received, by a respective PA, from a group of one or more directions. Particularly, each directional signal in a particular set of directional signals is indicative of an amplitude and phase of a signal/radiation received from a particular direction by the PA that corresponds to the particular set.

Alternatively or additionally, in some embodiments of the present invention the system is operative for utilizing the two or more PAs for coherent transmission of signals towards one or more predetermined directions. In this regard, it is noted that the coherency of the signal transmitted by the multiple PAs is first adjusted by the composite coherent integration module 100, which operates to adjust the phase differences between the signals transmitted by different PAs in accordance with their respective positions, and then by each of the PA coherent integration modules 95 which operates to adjust the phase differences between the signals transmitted by each of the transmitting/transceiving elements of the respective PAs. This thereby enables to coherently form directional elemental beams by transmitting signals from multiple PAs. It should be understood that in practice the operations of the composite coherent integration module 100 and the PA coherent integration modules 95 may be integrally implemented, and for example may be performed within the frame of a single processing operation e.g. performed by a single module.

Specifically, in transmission mode, the composite coherent processing module 100 receives (e.g. from the directionality processing module 105) a set of composite directional signals CDS. Each directional signal in the composite set CDS is indicative of the direction and amplitude at which a waveform S of a given wavelength λ should be transmitted by the arrangement 25 of the two or more PAs. Based on the set of directional signals CDS, the composite coherent processing module generates corresponding sets of directional signals $DS^{(1)}$ to $DS^{(L)}$ indicative of the directions and phases at which signals should be transmitted by PAs $PA^{(1)}$ to $PA^{(L)}$ respectively. Specifically, for each specific PA, $PA^{(i)}$, the composite coherent processing module 100 applies phase corrections to the set of directional signals CDS and thereby generates a corresponding set of directional signals $DS^{(i)}$ to be transmitted by the respective $PA^{(i)}$. The phase corrections introduced for each specific PA are determined based on the location of the specific PA (e.g. on the disposition between the specific PA and other PAs in the arrangement 25) and possibly also on the orientation of the PA. In general, the phase relation between the directional signals of the general set CDS and those of the particular PAs is given by equation 9 below.

In turn, the PAs coherent integration module 95 is adapted for receiving two or more sets of directional signals $DS^{(1)}$ to $DS^{(L)}$ associated respectively with the two or more PAs. Each particular set $DS^{(i)}$ includes one or more directional signals indicative of an amplitude and phase of a wavefront-signal/radiation to be transmitted by its respective PA towards a particular direction. Then, PAs coherent integration module 95 performs coherent integration on each set of directional signals $DS^{(i)}$. The coherent integration is performed based on a given wavelength of the signals to be transmitted (for example as by the coefficients from the matrices of any one of the equations 2 to 4 below), thereby converting the set $DS^{(i)}$ of directional signals to a set of signal portions in the spatial domain $SP^{(i)}$. Each set of signal portions $SP^{(i)}$ in the spatial domain is therefore indicative of the amplitude and phase by which transceiver elements of its corresponding PA of should be transmitting in order to generate transmitted waveforms with the directions and phases as indicated by the corresponding set of directional signals $DS^{(i)}$. The sets of signal portions $SP^{(1)}$ to $SP^{(L)}$ may then be communicated respectively to each of the transceiving elements 15 of the two or more PAs, $PA^{(1)}$ to $PA^{(L)}$ respectively, to thereby affect coherent transmission of signal/radiation/waveform propagating in the desired directions as indicated by the sets of directional signals $DS^{(1)}$ to $DS^{(L)}$.

As noted above, significant improvement to the SNR of the system of the present invention when in receiving mode/configuration and/or to the improvement to the power and accuracy of transmitted signals when in transmission mode/configuration is achieved by the composite coherent processing of the directional signals $DS^{(1)}$ to $DS^{(L)}$ taking into consideration the arrangement of the two or more PAs. Namely considering the distances and directions of the separations between the two or more PAs and compensating for the phase shifts, a signal would suffer when being transmitted and/or received by the two or more PAs.

To this end, the processing utility of the present invention includes a composite coherent processing module 100 that is configured and operable to carry out coherent processing coherently relating to the sets of directional signals $DS^{(1)}$ to $DS^{(L)}$ (which are described above and respectively associated with the two or more PAs) with a set of composite directional signals CDS, each of which is indicative of the amplitude at which a waveform S of a given wavelength λ is received and/or should be transmitted in a certain particular direction as by the arrangement 25 of the two or more PAs. The composite coherent processing module 100 may be configured and operable as a digital system, as an analogue one, and/or as a hybrid system carrying out various processing operations in analogue and digital domains. Specifically, configured digitally, the composite coherent processing module 100 may include or be associated with a DSP module and possibly with a storage/memory module, and may be adapted to carry out digital calculations corresponding to method steps 70 and 75 described below with reference to FIG. 2B. Alternatively or additionally, in embodiments in which the composite coherent processing module 100 is implemented analogically (or partially analogically) it may be configured based on various techniques of analogue signal processing, for example utilizing phase shifters and/or utilizing an arrangement of transmission and delay lines and/or utilizing acoustic/optical interference signal processing. A hybrid system might also include analogue-to-digital (A/D) converters and/or digital-to-analogue (D/A) converters for converting signals from analogue to digital, and vice versa.

In a receiving operational-mode/configuration of the system of the invention, the composite coherent processing module 100 is configured and operable for applying a coherent integration (also referred to below as second coherent integration see method step 75) to the two or more sets of the directional signals $DS^{(1)}$ to $DS^{(L)}$ to thereby determine a set of one or more composite directional signals CDS wherein each composite directional signal is indicative of an amplitude by which an incoming waveform S (e.g. signal/radiation) was received by the two or more PAs from a particular direction. This thereby enables to determine one or more directions of propagation of the incoming waveform with improved signal to noise ratio.

Alternatively or additionally, in a transmitting operational-mode/configuration of the system of the invention, the composite coherent processing module 100 is configured and operable to receive a directional data/signal set CDS indicative of one or more wave-fronts which should be generated and transmitted by the plurality of phased arrays $PA^{(1)}$ to $PA^{(L)}$ wherein each of the signals/data portions in the set CDS is indicative of an amplitude and direction towards which a respective wave-front should be radiated by the arrangement 25 of phased arrays $PA^{(1)}$ to $PA^{(L)}$. The composite coherent processing module 100 processes the directional data/signal set signals to derive therefrom the sets of directional signals $DS^{(1)}$ to $DS^{(L)}$ to be transmitted by the corresponding PAs, $PA^{(1)}$ to $PA^{(L)}$, for generating the desired wave-fronts (e.g. wavefront S). Specifically, the composite coherent processing module 100 generates for each of the PAs (e.g. $PA^{(i)}$), a corresponding set of directional signals (e.g. $DS^{(i)}$) by introducing proper phased shifts to the directional signals of the common set CDS. The proper phase shifts for each of the PAs are determined based on the respective location of the respective PA and/or based on the disposition between the PAs. Therefore, in the transmission mode, the phases of each channel/antenna-element of each PA are set as a sum of two phase shifts. The first phase shift is applied by the composite coherent processing module 100 and corresponds to the location of the PA and its disposition from other PAs in the arrangement 25 and the second phase shift is applied by the coherent integration module 95 and corresponds to the internal location of the antenna element within its respective PA. Thus, the actual transmission phase within each channel/antenna-element is the sum of these two phases.

As illustrated schematically in FIG. 1A, the processing utility 10 may optionally include additional modules in accordance with the configuration of the transceiving system 1 according to various possible embodiments of the present invention. For example, in some embodiments of the invention the $PA^{(1)}$ to $PA^{(l)}$ may be not aligned (e.g. not co-planarly or collinearly arranged) on a common line/plane X. To this end, the processing utility 10 may include a transceiver module 90 configured to operate as phase-alignment module 92 adapted to modify the phases of the signals destined to/from the different transceiving elements 15 to co-phase those signals for compensating the misalignment between the PAs $PA^{(1)}$ to $PA^{(l)}$. This can be achieved for example by application of proper phase delays (e.g. utilizing suitable arrangement of analogue phase delay elements associated with one or more PAs) that are selected to delay the signals received by a particular PA in accordance with the degree of misalignment of the particular PA from the common line/plane P (e.g. according to the deviation of its position/orientation from a common line/plane P of the PA arrangement 25).

It is noted that the transceiver module 90 may alternatively or additionally include for example an arrangement of signal filters (e.g. band-pass filters), delay-lines, amplifiers and/or attenuators and may be adapted for providing filtering, phase shifting and/or attenuating/amplifying to signals destined from/to the PAs. In digital implementation of the system 1 of the invention, the transceiver module 90 may also include A/D converters for sampling the analogue signals received by the transceiving elements 15 and converting them to digital signals/data; additionally or alternatively it may include D/A converters for converting digital signals to analogue signals that can be transmitted by the transceiving elements 15. In some embodiments the transceiver module 90 includes multiple transceivers $\mathbf{90}^{(1)}$ to $\mathbf{90}^{(l)}$ which are respectively associated with the two or more PAs $PA^{(1)}$ to $PA^{(l)}$. Also in some embodiments, transceiver module 90 is configured and operable for carrying out steps 45 and 50 of the method 40 described below with reference to FIG. 2B for sampling and co-phasing the signals from the transceiving elements 15.

Also, according to some embodiments of the present invention the transceiver module 90 is configured to carry out method step 50 for co-phasing the signals received from the different PAs by applying projection of all PA's (i.e. of the signals' signal portions $SP^{(1)}$ to $SP^{(L)}$ received therefrom or transmitted thereby) on a common plane. In this regard, in reception mode, the phases of signals $SP^{(1)}$ to $SP^{(L)}$, which are received by the elements of the respective PAs $PA^{(1)}$ to $PA^{(l)}$, are adjusted as if they are received by co-planar and/or co-linear PAs. Accordingly, in transmission mode, the phases of the signals $SP^{(1)}$ to $SP^{(L)}$ generated by the coherent integration module 95, are adjusted in accordance with the respective positions and orientation of the PAs $PA^{(1)}$ to $PA^{(l)}$ which correspond thereto such as to allow the PAs $PA^{(1)}$ to $PA^{(l)}$ to coherently transmit the mutually coherent signals $SP^{(1)}$ to $SP^{(L)}$ for forming the desired wave-front(s) S.

In this connection it should be noted that co-phasing the signals for compensating different orientations and/or misalignments between the PAs may depend on the angular-frequency of the signals $SP^{(1)}$ to $SP^{(L)}$ which are received and/or transmitted by the arrangement 25. Specifically, in some radar applications, in which both the frequency and direction of the wavefront to be received and/or transmitted are a priori known, the angular frequency of the wavefront is thus also known. This facilitates the performance of co-phasing only for this angular frequency (i.e. and/or only for certain one or more predetermined angular frequencies).

However, in some cases the angular frequency(ies) of the wave-front/signals $SP^{(1)}$ to $SP^{(L)}$ transmitted/received by the system is not known a priori. In such cases, according to some embodiments of the invention, co-phasing of signals $SP^{(1)}$ to $SP^{(L)}$ from non-co-planar and/or non-co-linear PAs is independently performed in step 50 for each of the angular frequencies of interest. Then, the following steps of method 40 are also performed independently for each of the angular frequencies for which co-phasing is performed in step 50.

In some embodiments of the present invention the different PAs 25 may be associated with different numbers and arrangements of their transceiving elements 15. Accordingly, the sets of directional signal $DS^{(1)}$ to $DS^{(L)}$ of different PAs may be associated with somewhat different directions (different direction groups). This is because the Fourier transforms of signals obtained at different arrays of elements 15 with different numbers and spacings of their elements may provide different directional resolutions. To this end, the processing utility 10 may optionally include an interpolation module 98 that is configured and operable for interpolating the directional signal sets $DS^{(1)}$ to $DS^{(L)}$. Specifically, in receiving configuration of the present invention the interpolation module 98 directional signal sets $DS^{(1)}$ to $DS^{(L)}$ are indicative of different groups of directions, and interpolates at least one of them such that the resulting directional signal sets $DS^{(1)}$ to $DS^{(L)}$ are associated with a common group of directions. The operation of the interpolation module 98 in this regard is described in more detail below with reference to method step 65 of the method 40.

Also, in some embodiments one or more of the PAs may be configured with the spacing distances between transceiving elements 15 being greater than half the wavelength $\lambda$ (namely with spatial sampling frequency lower than the Nyquist frequency. In such cases the interpolation module 98 may also be configured and operable to unfold the directional signal sets (e.g. $DS^{(1)}$ to $DS^{(L)}$) that are associated with the PAs for which the spatial sampling frequency is lower than the Nyquist frequency. The operation of the interpolation module 98 in this regard is described in more detail below with reference to method step 60 of the method 40.

It is noted that the interpolation module 98 may be implemented analogically (e.g. by a network of phase delays and attenuators) or digitally (e.g. utilizing a DSP configured to operate with any suitable interpolation algorithm). In some embodiments the interpolation module 98 includes an arrangement of one or more interpolators (e.g. $98^{(1)}$ to $98^{(l)}$) which may be respectively associated with each one of the PAs $PA^{(1)}$ to $PA^{(l)}$ for which interpolation/unfolding of it directional signal sets is thought to be required. Alternatively or additionally, it is also noted that according to some embodiments of the invention the interpolation module 98 (e.g. its functionality) may be integrated with the PAs coherent integration module 95 by configuring the PAs coherent integration module 95 to carry out interpolation (at least partially) together with the Fourier analysis (e.g. based on zero-padding fast Fourier transform (FFT) algorithms).

According to some embodiments, the processing utility 10 optionally includes directionality processing module 105 that is configured and operable to process the composite directional signals CDS. In transmission configurations/operation-modes of the transceiving system 1 of the present invention, the directionality processing module 105 is configured and operable to determine the directions and amplitudes towards which signals/waveform S should be transmitted by the PAs arrangement 25 and accordingly to construct the composite directional signals CDS which are then provided to the composite coherent processing module 100. The latter then derivates therefrom the directional signal sets $DS^{(1)}$ to $DS^{(L)}$ to be transmitted by each of the PAs $PA^{(1)}$ to $PA^{(l)}$ respectively. Alternatively or additionally, in receiving configurations/operation-modes of the transceiving system 1 of the invention, the directionality processing module 105 is configured and operable to obtain/receive the composite directional signals CDS from the composite coherent processing module 100 and process them to determine directions from which prominent signals/waveforms S were received by the PAs arrangement 25. This operation of the directionality processing module 105 is described more specifically below within the scope of step 75 of the method 40.

Figure 2A:
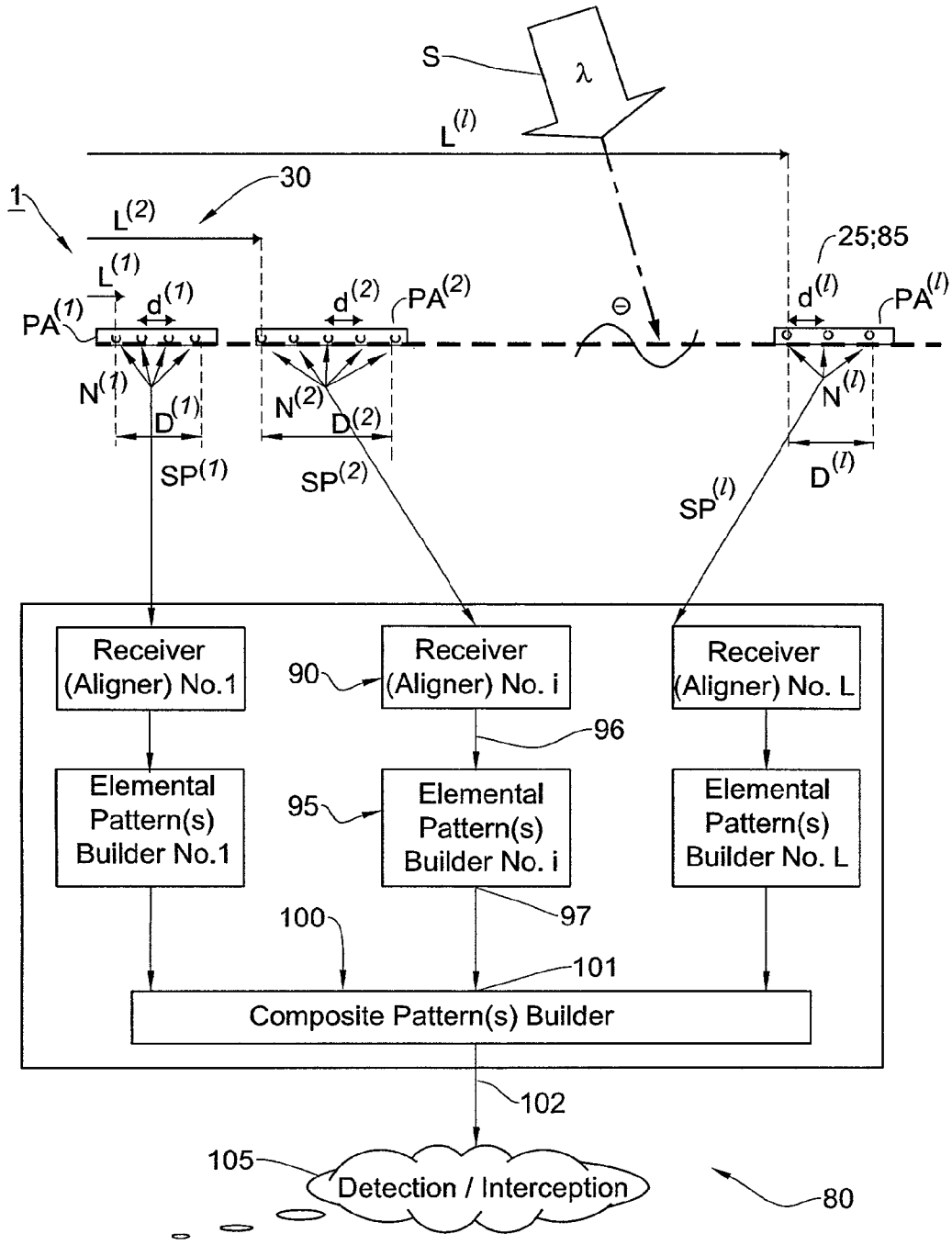
FIGS. 2A and 2B schematically illustrate a receiving system configured according to the present invention and a method according to the present invention for processing the signals received by the receiving system.
Figure 2B:
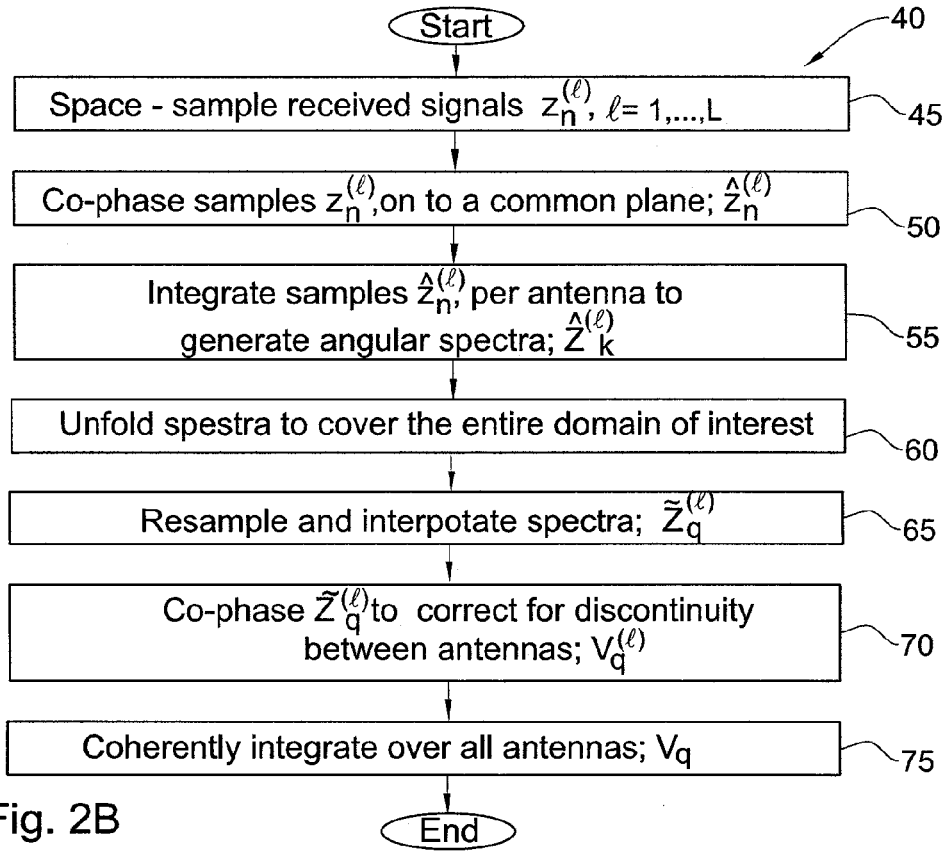

Reference is made together to FIGS. 2A and 2B schematically illustrating a receiving system 1 configured according to the present invention and a method 40 for processing the signals received by the receiving system 1. The receiving system is configured in accordance with the present invention and includes modules whose functional operation for receiving and processing incoming waveform(s)/signals S is similar to that described above with reference to FIG. 1A. Accordingly reference numerals similar to that of FIG. 1A are also used in FIG. 2A to indicate modules/elements with similar functionality.

As noted above, the technique of the present invention may be used for analyzing directionality of waveform signals (e.g. electro-magnetic (EM), acoustic sonic/ultra-sonic) received by a multitude of transceiving-elements 15 e.g. antenna/microphone elements). The transceiving-elements0, in which 15 may also be in this example receiving elements as in the scope of method 4 the technique of the invention for receiving signals is particularly exemplified. The receiving-elements 15 are arranged in multiple (two or more) PAs arrays/groups $PA^{(1)}$ to $PA^{(l)}$ (e.g. one or two dimensional grid-like arrays such as phased array antennas) in uniform spatial distribution in each array. For example, in each PA, the receiving-elements may be arranged with fixed distances and/or with equal mutual spacing between adjacent receiving-elements along each dimension of the array. The equal, mutual spacing between the receiving-elements may be different for different PAs, and may be different along different directions/dimensions of arrays.

Specifically, in the embodiment of the invention illustrated in FIG. 2A, the system 1 includes a set of phased array antennas 85 (being an example of arrangement of phased arrays 25 of FIG. 1A) which are spatially arranged with dispositions between them. System 1 also includes a processing utility 10 adapted to receive and process the signals received by the phased array antennas 85 in accordance with method 40 below. Thus, in this example, coherent signal detection from a set of phased array antennas 85 is achieved (although arrays of other types of receiving elements may be used as well) which may be configured for example for target detection (e.g. in radar applications) and/or for signal interception (e.g. SIGINT). For clarity, and by way of an example only, a one dimensional arrangement of the phased arrays 25 along the X axis is considered, as schematically illustrated in FIG. 2A. This arrangement of the phased arrays 25 allows to determine the directionality a waveform S received by the receiver elements 15 with respect to the angle Θ between the direction of propagation of the waveform S and the X axis (angle Θ referred to herein as azimuth angle). It should be understood the extension of the technique described herein for providing estimation of the direction of arrival of an the waveform S with respect to both azimuth Θ and elevation/altitude ϕ angles is straightforward and would readily be appreciated by those skilled in the art.

In FIG. 2A the geometrical arrangement 25 of L antenna arrays (transceivers/phased arrays) is illustrated as follows. The transceivers/phased arrays are denoted by $PA^{(1)}$ to $PA^{(L)}$. Each individual phased array $PA^{(i)}$ includes a specific number $N^{(i)}$ of transceiver/receiver elements 15 arranged at fixed distances (here equal mutual spacing) $d^{(i)}$ between adjacent receiving-elements 15 in the array. The positions along the X axis of, and of each first receiver element in the PAs $PA^{(1)}$ to $PA^{(L)}$, are respectively denoted in FIG. 1A and by $X^{(1)}$ to $X^{(L)}$. The extent/length of each phased array $PA^{(1)}$ to $PA^{(L)}$ along the X axis is respectively denoted in FIG. 1A by $D^{(1)}$ to $D^{(L)}$. Actually the length $D^{(i)}$ of phased array $PA^{(i)}$ satisfies $D^{(i)}=(N^{(i)}-1)*d^{(i)}$.

Additionally, processing utility 10 includes PA coherent integration module 95 including in this example a set of pattern builders which are respectively connectable to a set of receivers 90 (of the receiver module) and adapted for separately receiving the signal portions $SP^{(i)}$ obtained by the receivers 90 and for separately performing a first coherent addition of these signal portions (in accordance method step 55 below) to combine the signals from each phased array antenna 85 (e.g. performing a first angular Fourier transform on the signals of each receiver) and obtain directional signals $DS^{(i)}$ corresponding to each phased array antenna. Further, processing utility 10 includes a composite coherent processing module 100 (also referred to herein below as composite pattern builder) that is connectable to the set of pattern builders 95 and configured and operable receiving therefrom the coherently combined signals $DS^{(i)}$ (i.e. sets of directional signals) associated with each of the phased array antennas 85 and performing a second coherent integration/addition to combine together the signals from all of the phased array antennas 85 (e.g. performing method steps 70 and 75 below) and thereby obtain a set of composite directional signals as noted above. It is noted that the set of pattern builders 95 and/or the composite pattern builder 100 may be configured to carry out the operations of method steps 60 and 65 of method 40 described below.

Turning now to FIG. 2B there is illustrated by way of a flow diagram a method 40 according to the invention which is carried out by the processing utility 10. Method 40 illustrates in detail a specific receiving operation of the transceiving system 1 of any one of FIGS. 1 and 2A when it is configured and/or operated as a receiving system. Namely the method illustrates the operations carried out by the processing utility 10 for processing the data/signal portions $SP^{(1)}$-$SP^{(l)}$ that are associated with the waveform S as received/sampled by the PAs $PA^{(1)}$ to $PA^{(l)}$ in order to determine data indicative of the direction(s) of the waveform S.

It will be readily understood to a person of ordinary skill in the art how to modify the method 40 in order to obtain the system's operation in transmittance-mode/configuration. Particularly as noted above, in transmission mode, a reference signal to be transmitted (e.g. directional signals CDS) should be fed for coherent transmission by all the channels (e.g. by all the antenna elements of the arrangement of PAs 25). As described above a two-stage setting of the transmission phase is performed respectively by modules 100 and 95 to adjust the phases of the signals to be transmitted by each of the different PAs and by each specific antenna-element/channel of those PAs.

Considering that the geometrical arrangement 25 of phased array antennas in FIG. 2A is a collinear arrangement (co-planar arrangement in the two-dimensional case) along the X axis, the position $x_n^{(l)}$ of a receiver n of array $PA^{(l)}$ with respect to the X axis is $x_n^{(l)}=X^{(l)}+n*d^{(l)}$ (n being zero based index). Therefore, in the 1D case, a given waveform signal S of wavelength λ, arriving with angle Θ with respect to the X axis, would be space-sampled/received by the elements of the phased arrays to generate the sampled signal $\hat{z}_n^{(l)}$ as follows:

$$\hat{z}_n^{(l)}=A*e^{2*\pi*j*U_0*x_n^{(l)}} \quad \text{Eq. (1)}$$

Where $\hat{z}_n^{(l)}$ represents the signal sampled by the n-th element of the l-th phased array $PA^{(l)}$. Here A is the signal's amplitude and $U_0$ represents the angular frequency of the signal and is given by $U_0=\cos(\Theta)/\lambda$ where Θ is the angle between the direction of propagation of the impinging/incoming signal and the line/plane along which the arrays lies, $x_n^{(l)}$ specifies the location of the n-th element/receiver in the l-th array and j is the imaginary unit. It is noted that Eq. (1) is also true in the transmitting configuration of the present invention when considering the signal $\hat{z}_n^{(l)}$ that should be transmitted by the n-th elements of the l-th phased array $PA^{(l)}$ to generate the waveform signal S of wavelength λ propagating with angle Θ.

It should be understood that the frequency of the waveform signal S, and/or accordingly its wavelength λ, may be given parameters. For example, such parameters may be known for example in active radar systems which operate for transmitting a signal of known frequency(ies) and receiving the signal response. Alternatively or additionally, the frequency/wavelength of the signal may be calculated/processed by utilizing known in the art time domain analysis of the signals received at one or more of the receiving-elements 15. For example, the frequency, and thereby wavelength of the incoming signals may be determined based on the technique disclosed in U.S. Pat. No. 8,022,874 co-assigned to the assignee of the present application.

It should be understood that an actual signal $\hat{z}_n^{(l)}$ received and/or transmitted by phased array antenna l may generally include a linear combination of a plurality of signals which are associated with different frequencies and/or different directions of propagation. Specifically, such a signal may be represented in accordance with equation (1) above as a sum of one or more signals having different amplitudes $A^S$ and different angular frequencies $U_0^S$ as follows:

$$\hat{z}_n^{(l)}=\sum_S A^S*e^{2*\pi*j*U_0^S*x_n^{(l)}}$$

where s is an index indicating portions of the signal $\hat{z}_n^{(l)}$ which are associated with different angular frequencies. In the receiving configuration of the present invention the processing utility 10 is configured and operable to carry out method 40 in order to determine with improved SNR the direction(s) from which waveform signals S of a given wavelength λ are received by the phased arrays 25. Specifically the processing utility 10 may be configured to determine the azimuth angle Θ when utilizing the one dimensional (1D) configuration of the arrangement 25 of phased arrays antennas $PA^{(1)}$ to $PA^{(1)}$ and/or to determine both azimuth Θ and elevation Φ when utilizing the two dimensional (2D) arrangement 25 of phased arrays antennas $PA^{(1)}$ to $PA^{(l)}$.

In step 45, incoming signals S impinging on the phased arrays 25 are space-sampled/received by the receiving elements 15, which are distributed over different locations in the 3D space, to form the sampled signal data $\hat{z}_n^{(l)}$. This actually means that the properties of the incoming signals S are captured by the antenna elements which are distributed over different locations in the 3D space. In a digital configuration of the present invention, the receiver elements 15 are preferably substantially simultaneously sampled to generate two or more corresponding arrays of sampled values $\hat{z}_n^{(l)}$(noted in the FIGS. 1 and 2A by the sets of signal portions $SP^{(1)}$-$SP^{(l)}$. The sampled values $\hat{z}_n^{(l)}$ are provided to/obtained by the processing utility 10. Additional, conventional steps which are well known to those versed in the field may also be carried out in this step for sampling the signals, digitizing them and providing them to the processing utility 10.

It should be noted here that, indeed, in an analogue configuration of the system of the invention the signal portions $SP^{(1)}$-$SP^{(l)}$ would be received and represented by analogue signals and not as sampled signal values $\hat{z}_n^{(l)}$. However for clarity of the following description of method 40 the $SP^{(1)}$-$SP^{(l)}$ will be considered as sampled values $\hat{z}_n^{(l)}$. It should thus be understood that although the following description of method 40 utilizes somewhat digital processing terminology, steps of this method 40 are applicable in both digital and/or analogue processing techniques as will be appreciated by those skilled in the art.

In some embodiments of the invention the phased arrays $PA^{(1)}$-$PA^{(l)}$ are not arranged collinearly/co-planarly with respect to one another. Optionally, in such cases, step 50 may be carried out on the sampled signals $\hat{z}_n^{(l)}$ to co-phase the signals onto a common plane/line. This step is described in more detail below.

In step 55, sampled signals received by the elements 15 of each of the phased arrays 25 are processed together to generate directional signal/data portions $DS^{(1)}$-$DS^{(l)}$ (i.e. angular frequency spectra) corresponding respectively to each of the of the phased arrays $PA^{(1)}$-$PA^{(l)}$. This processing is carried out based on the known techniques (Fourier analysis/transform technique) for separately performing angular transform on the signals $\hat{z}_n^{(l)}$(e.g. angular Fourier transform) sampled by each of the phased array l. The angular Fourier transform for each phased array $L^{(l)}$ is as follows:

$$Z_k^{(l)} = \sum_{n=0}^{N^{(l)}-1} \hat{z}_n^{(l)} * w_n * e^{-j*2*\pi*n*d^{(l)}*U_k} \equiv F_{k,n}^{(l)} * \hat{z}_n^{(l)} \quad \text{Eq. (2)}$$

Where $F_{k,n}^{(l)} \equiv w_n * e^{-j*2*\pi*n*d^{(l)}*U_k}$ is a Fourier transform matrix of each PA $PA^{(l)}$.

$U_k = \cos(\theta_k)/\lambda$ is the k-th angular frequency filter applied to a detected signal $k=0, \ldots, K^{(l)}-1$, $l=1, \ldots, L$ Utilizing for example the angular frequencies of Discrete FT (DFT) the relation between $\Theta_k$ and k is given by $$U_k = \cos(\vartheta_k)/\lambda = \frac{k}{Kd}\left(\text{namely } \vartheta_k = \arccos\left(\frac{k\lambda}{Kd}\right)\right).$$

$\hat{z}_n^{(l)}$ being the directional signal/data portion (angular frequency spectrum) of the l-th phased array. L being the number of phased arrays, $N^{(l)}$ is the number of receiving-elements arranged in the l-th array. $L^{(l)}$ along the X axis and $d^{(l)}$ is the spacing between the receiving-elements of the l-th array, n is the receiver's index in the X axis direction and $w_n$ is a weighting factor used to control the side-lobes of the reception/transmission beams of the phased arrays. $K^{(l)}$ is the number of the angular frequencies (directions) to be obtained/processed for the l-th array. It is noted here that the term angular frequency generally refers to a spatial angular frequency and accordingly its units dimensionality is 1/length. It is also noted that since the signal has a predetermined wavelength $\lambda$ each specific angular frequency k corresponds to a particular direction of propagation of the waveform signal S.

Step 55 is described above in connection with the receiving configuration of the present invention. In general, in a transmission mode/configuration, if one would desire to transmit beams in plurality of directions, one could use the same steering matrix for both the receive and transmit modes (i.e. by applying the Fourier transform corresponding to the Eq. (2) above in the transmit mode). Practically, however, in a typical transmit mode, only one beam or a few beams are transmitted to respective one or a few directions. Thus, in such cases where beams are not transmitted to all directions (e.g. the directional sets of signals include only one or few directional signals to be transmitted in one or few directions), then step 55 may be performed more efficiently by multiplying each directional set of signals $DS^{(i)}$ (to be transmitted by a respective PA $PA^{(i)}$) by a corresponding steering matrix $S^{(i)}$ wherein the steering matrix $S^{(i)}$ may consist only of the vectors (referred to herein as steering vectors) that correspond to the actual directions to which signals are to be transmitted. Namely in this case, the steering matrix $S^{(i)}$ (corresponding to the respective PA indexed i) includes only steering vectors corresponding to the actual directional signals which are included in the respective directional sets of signals and which are to be transmitted. The steering matrices may actually be equivalent to the operations of equations 2 to 4 herein. Specifically, the phases of the steering vectors are adjusted (e.g. by modules 100, 95) for each PA and each element of the PA. Each steering-vector of a steering matrix of a certain PA characterizes the phases associated with transmittance of a specific beam/directional-signal towards a certain direction by the respective PA wherein the vector values represent the relative phases by which the signals are to be transmitted by the elements of the respective PA. These relative phases are calculated for each specific direction to which transmission is due by taking into account the relative phase delays which are incurred on signals transmitted by different elements of the same or different PAs (e.g. due to the relative dispositions between the elements) as those signals/wavefronts propagate in the specific direction.

It should be noted that in cases where the receiver elements 15 of each phased array $PA^{(l)}$ are arranged in mutual equal spacings (i.e. equally distant) from one another by spacing $d^{(l)}$, the angular Fourier transform of Eq. (2) may be performed utilizing a discrete Fourier transform (DFT) with the equi-distant samples of the angular spectrum at $k*\Delta U^{(l)}$ as in the following:

$$Z_k^{(l)} = \sum_{n=0}^{N^{(l)}-1} \hat{z}_n^{(l)} * w_n * e^{\frac{-j*2*\pi*n*k}{K^{(l)}}} \quad \text{Eq. (3)}$$

where $\Delta U^{(l)} = 1/(d^{(l)}K^{(l)})$;

namely utilizing the set of angular frequencies $k*\Delta U^{(l)}$ of DFT.

In some embodiments of the invention, a non-zero-padded angular Fourier transform is applied as in Eq. (2) and Eq. (3). In such cases the number of the directions (number $K^{(l)}$ of angular frequencies), which may be obtained from each array of receiving-elements $PA^{(l)}$, equals to the number $N^{(l)}$ of receiver elements 15 which are arranged in array $PA^{(l)}$ with respect to the X axis. Alternatively or additionally, in some embodiments of the invention, interpolation of the received signals is thought to be achieved by zero-padding the samples $\hat{z}_n^{(l)}$ of the signal portions $SP^{(i)}$ received at least some of the arrays $PA^{(1)}$ to $PA^{(L)}$. In the latter case, the number $K^{(l)}$ of the angular frequencies, which may be obtained by the angular Fourier transform, is equal to the number of the samples from the $N^{(l)}$ elements of the array plus the zero padded 'samples'.

In some cases, determining the strength of signals arriving to the antenna arrays $PA^{(i)}$ is required only for a certain one or more particular directions. Accordingly the above Fourier analysis (e.g. angular Fourier transform) may be carried for only a subset of the angular frequencies $U_k$ (e.g. for only certain k's). Namely, to obtain only a desired subset of the possible directional signals $DS^{(i)}$ which can be derived from the signal portions received $SP^{(i)}$ from one or more of the arrays $PA^{(i)}$. In such cases the above angular transform may be carried out only over those respective angular frequencies k indexes which correspond to the required one or more directions. This reduces the amount of processing and thus reduces the processing time needed. Also, the nature of the above Fourier analysis (coherent integration) may vary from one system to another. It may be implemented by analog hardware or by digital hardware and by utilizing for example discrete-FT (DFT), fast-FT (FFT) procedures or other suitable procedures.

For example, for active radar applications which actively transmit a signal and receive its response, the general direction(s) from which a response is expected and may be received at a certain time frame may be a priori known based on the directions towards which the signals were transmitted, and the times of their transmission. Accordingly in such applications at each time frame the angular transform may be carried out only for the subset of k's corresponding to the desired direction(s). Alternatively or additionally, in signal interception applications, the angular Fourier transform may be calculated for all the possible k's (all possible directions) in order to monitor and detect signals arriving from multiple directions in a surveillance space.

It should be noted that in a 2D configuration of the transceiving/receiving system 1 of the present invention (in which two dimensional arrangement 25 of the PAs $PA^{(1)}$ to $PA^{(l)}$ are used), the above described Fourier analysis may be carried out by calculations somewhat similar to that of Eq. (2) or Eq. (3) above but in which two dimensional integration is performed on the two dimensional array of sampled values $\hat{z}_{n^x n^y}^{(l)}$ received from each two dimensional phased array/phase-antenna-array. Such a transform is exemplified in the following Eq. (4). As would be readily appreciated by those skilled in the art, in a transmitting configuration of the present invention, this transform might be applied in a similar manner or in some cases as noted above, it might be applied more efficiently by multiplying the directional signals themselves by respective steering vectors and feeding them to the respective PAs.

$$Z_{k_x k_y}^{(l)} = \sum_{n_x=0}^{N_X^{(l)}-1} \sum_{n_y=0}^{N_Y^{(l)}-1} \hat{Z}_{n_x n_y}^{(l)} * w_{n_x n_y} * e^{-j*2*\pi*n_X*d_X^{(l)}*U_{k_X}} * e^{-j*2*\pi*n_Y*d_Y^{(l)}*V_{k_y}} \equiv F_{k_x k_y n_x n_y}^{(l)} * \hat{Z}_{n_x n_y}^{(l)} \quad \text{Eq. (4)}$$

Where $$F_{k_x k_y n_x n_y}^{(l)} \equiv w_{n_x n_y} * e^{-j*2*\pi*n_X*d_X^{(l)}*U_{k_X}} * e^{-j*2*\pi*n_Y*d_Y^{(l)}*V_{k_y}}$$

is a 2D FT matrix $$U_{kx} = \sin(\vartheta_{k_x})/\lambda,\ V_{ky} = \sin(\phi_{k_y})/\lambda$$

$$k_x = 0, \ldots, K_x^{(l)} - 1,\ k_y = 0, \ldots, K_y^{(l)} - 1,\ l = 1, \ldots, L$$

Here the same notations are used as in Eq. (2) with only additional subscript indicating the reference to the x or y directions. Namely $\hat{z}_{n^x n^y}^{(l)}$ being a two dimensional array of sampled signal values which are sampled from the two dimensional phased array $PA^{(i)}$. L being the number of phased arrays, $N_X^{(l)}$ and $N_Y^{(l)}$ are the number of receiving-elements arranged in the l-th array $PA^{(l)}$ in the X and Y directions respectively, and $d_x^{(l)}$ and $d_y^{(l)}$ are the spacing between the receiving-elements in the respective directions, $n_x$ and $n_y$ are the receiver indexes along the X and Y directions of the array and $w_{n^x n^y}$ is a weighting factor. $K_x^{(l)}$ and $K_y^{(l)}$ are the numbers of the angular frequencies to be obtained/processed for the l-th array with respect to the Θ and Φ angles.

The Fourier analysis (angular Fourier transform) described above in Eq. 2 to 4 is actually a coherent integration which is performed separately on each set of signal portions $SP^{(i)}$ detected by the receiver elements 15 of each phased array $PA^{(i)}$ respectively. The coherent integration is performed for each direction of interest (each particular k) by adding the signals measured by multiple receiving-elements of an array while multiplying the signal from each receiver element by a complex phase factor corresponding to the phase difference/shift that was incurred on an incoming signal S of wavelength λ and direction Θ when it was propagating to different receiving-elements of the respective $PA^{(i)}$. The results of the above calculated angular transform for each of the phased arrays $PA^{(1)}$-$PA^{(l)}$, is a directional data $DS^{(l)}$ in the form of an array (one or two dimensional) of complex values in which the value of each cell of the array corresponds to the amplitude and phase of an incoming signal received from a particular direction $\Theta_k$ ($\Theta_k$ and $\Phi_k$ in the 2D case). The directions $\Theta_k$ are expressed by the $U_k$ variables as noted above (for the 2D case Θ and ϕ are indicated by $U_k$ and $V_k$).

At this stage, considering the conventional techniques for processing the signals from multiple phased array antennas, only the amplitudes/powers (e.g. real/absolute values) of the directional signals (e.g. of $DS^{(1)}$ to $DS^{(l)}$) are combined while the phase data are generally ignored. Namely, the amplitudes of corresponding cells (corresponding k's) from different directional data arrays ($Z_k^{(l)}$) of different phased arrays $PA^{(l)}$ are added while ignoring their phases, thus ignoring the separation/distance between the phased arrays and ignoring the fact that the wavefront of the waveform signal S propagating at certain particular direction may arrive to the different phased arrays $PA^{(1)}$ at different phases. This generally results in loss of accuracy and reduced SNR in detection of the direction of an incoming signal. Also, the direction of propagation of the waveform signal S is determined separately for the different PAs, and thus the accuracy is limited by the apertures of the individual PAs which is smaller than the joint aperture of all the PAs. This results in decreased gain, decreased resolution and decreased accuracy of the signals detected/transmitted utilizing conventional techniques.

However, according to the technique of the present invention, different directional data arrays $Z_k^{(i)}$ corresponding respectively to the sets directional signals $DS^{(i)}$ (e.g. to the angular frequency spectra) of different phased arrays $PA^{(i)}$ are coherently combined/added by means of a second coherent integration which is performed, taking into account both the amplitude and the phase of the complex values in the directional data arrays $Z_k^{(l)}$ as described in the following. This second coherent integration is generally performed by the composite coherent processing module 100 based on geometrical properties of the arrangement 25 of the phased arrays $PA^{(i)}$ (e.g. based on geometrical data/information provided to the coherent processing module 100 regarding the dispositions between the receivers arrays $PA^{(i)}$ allowing it to process the phase shifts that would be incurred to incoming signals of particular wavelength λ arriving from particular directions $\Theta_k$. This second coherent integration of the angular frequency spectra $DS^{(i)}$ associated with signals received by several phased arrays $PA^{(i)}$ provides significant improvement to the SNR of the detection system of the present invention as compared with other known in the art systems.

The phase shifts that are incurred to incoming signals arriving to different phased arrays $PA^{(i)}$ depend on several factors listed in the following:

(i) the separations between the phased arrays $PA^{(i)}$;

(ii) the direction(s)/angle(s) $\Theta_k$ from which an waveform signal S is propagating; and (iii) the wavelength λ of the waveform signal S;

Thus, to account for those phase shifts and enable the coherent addition of signals received by the spatially separated phased arrays 25, the complex values in the directional data arrays $Z_k^{(l)}$ are adjusted. Specifically, the phases of the complex values in the cells of directional data arrays $Z_k^{(l)}$ associated with different phased arrays 25 are adjusted to compensate for such phase shifts. Each cell $Z_k^{(l)}$ of a directional data array (indexed l) is associated with a specific direction of arrival (index k) of the incoming signal and with a specific position and orientation of its respective phased array (l). Accordingly, the phase shift is calculated separately for each cell based on the position and orientation of the array (l), the direction of arrival of the signal (k), and the given/predetermined wavelength λ of the received signal. This procedure is described in the following with reference to Eq. (9) and/or equation 15 below.

Prior to the coherent addition/integration of the angular frequency spectra $Z_k^{(l)}$ of different phased arrays, the angular frequency spectra $Z_k^{(l)}$ of one or more of the arrays may be optionally unfolded to cover an angular spectral range/domain which extends beyond the Nyquist frequency. As generally known from the sampling theorem (Nyquist theorem), for a given spacing $d^{(l)}$ between receiving-elements in the i-th array $PA^{(i)}$, the maximal spatial angular frequency $U_{max}$ of an incoming signal that can be unambiguously resolved complies with $U_{max} \leq 1/(2d^{(l)})$. The angular frequency U of a waveform S of wavelength λ with direction of propagation Θ is perceived by a phased array $PA^{(i)}$ according to $U(\lambda,\Theta)=\mathrm{Cos}(\Theta)/\lambda$. This means that a given phased array $PA^{(i)}$ with spacing $d^{(l)}$ between its receiver elements provides only ambiguous directional results when detecting waveform S for which $U(\lambda,\Theta) \equiv \mathrm{Cos}(\Theta)/\lambda > 1/(2d^{(l)})$.

However, according to some embodiments of the present invention, this ambiguity is resolved by unfolding the angular frequency spectra $Z_k^{(l)}$ of at least one of the phased arrays $PA^{(i)}$ and combining the angular frequency spectra (folded and unfolded) $Z_k^{(i)}$ from the two or more phased arrays $PA^{(1)}$ to $PA^{(l)}$. The unfolded spectra $Z_k^{(l)}$ is generally expressly indicative of the directional ambiguity and typically includes additional angular frequency bins presenting angular frequencies which are not expressly shown in the corresponding folded spectra. Preferably, the frequency spectra $Z_k^{(i)}$ of each of the phased arrays $PA^{(i)}$ for which the spacing $d^{(i)}$ between its receiving elements 15 provides the Nyquist frequency below twice the angular frequency of the waveform signal S, would be $\lambda/(2*\mathrm{Cos}(\Theta)) < d^{(l)}$. The unfolded angular frequency spectra $Z_{k'}^{(l)}$ of any one phased array is generally aliased giving rise to explicit ambiguity in the detected directions of propagation of the waveform S. Resolving this ambiguity is achieved by combining the unfolded angular frequency spectra of one or more phased arrays with the frequency spectrum (folded or unfolded) of one or more other phased arrays. Preferably, according to some embodiments of the invention, at least some of the phased arrays $PA^{(i)}$ are associated with different spacings (e.g. $d^{(l1)} \neq d^{(l2)}$) between their receiving elements 15 thus further improving the system's ability to resolve the above described directional ambiguity.

Thus, in optional step 60 of method 40, the angular frequency spectra $Z_k^{(l)}$ of one or more of the phased arrays may be unfolded to cover a desired range of angular frequency spectra which may extend beyond the Nyquist frequency. For example, in step 60, $Z_k^{(l)}$ is unfolded so as to cover the entire angular frequency domain which is of interest in a specific application and is denoted here as $[U_{min}, U_{max}]$. Typically, the angular spectrum is unfolded to cover an angular domain of interest covering $[-\pi/2; \pi/2]$ intervals in both azimuth (Θ angle range) and elevation (Φ angle range). However, other azimuth and elevation ranges are possible as well. The unfolded frequency spectra $Z_{k'}^{(l)}$ may be processed from the folded spectra $Z_k^{(l)}$ as follows:

$$Z_{k'}^{(l)}=Z_k^{(l)}, k=k' \bmod K^{(l)}, k'=0, \ldots, K' \qquad \text{Eq. (5)}$$

Where [ . . . ] represents integer intervals and k' determines the centers of angular frequencies (angular frequency filters) for which the angular frequency spectra should be resolved. The angular frequency filters correspond to:

$$U_{k'}^{(l)} = U_{min} + k' * \frac{1}{d^{(l)} K^{(l)}} \qquad \text{Eq. (6)}$$

It should be noted that in a transmission configuration/operational mode of the present invention, step 60 may be obviated.

The difference between receiving and transmitting operational modes/configurations is that in the receiving operational mode, the directional signals from all of the PAs are summed coherently after being co-phased (e.g. multiplied by the steering matrix/vector), to compensate for the discontinuity/dispositions between the phased arrays $PA^{(1)}$ to $PA^{(l)}$ (as specifically illustrated below in equation 9), while in the transmission operational mode the actual summation occurs in free space by the combination of the signals/waveforms radiated from the of antenna elements of the plurality of PAs. Specifically, in the transmission operational mode, directional signals CDS to be generated as waveforms by the plurality of PAs are determined and the phases of those signals are independently adjusted for each of the PAs by utilizing an independent steering matrix for each PA.

Figure 4:
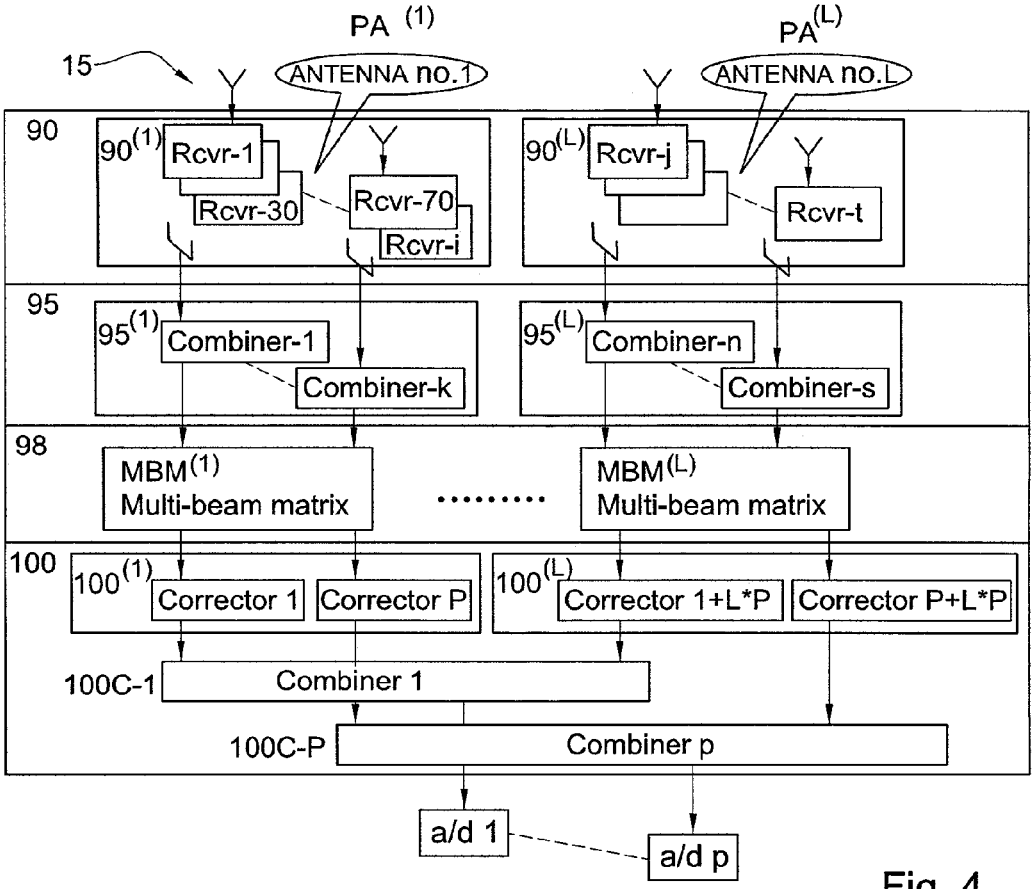
FIG. 4 illustrates schematically a transceiver system according to an embodiment of the present invention which is configured and operable to generate an angular receiving pattern that is associated with simultaneous receiving of more than one directional beams.

It should be also understood that in the analog systems, the angular frequency spectra are unfolded from the very beginning (e.g. specific hardware, such as analog line, may be utilized for each directional-signal/beam to be calculated/unfolded and transmitted at a certain direction by each certain PA. As depicted in FIG. 4, the analog hardware associated with each PA, generates as a set of signal inputs (corresponding to beams received by the PAs from one or more directions) to the multi-beam matrix 98, which in turn outputs directional signals (elemental beams).

However this might not be the case when the angular Fourier transforms of any one of equations (2), (3) or (4) is implemented utilizing the FFT algorithm. In the latter case, the spectrum is usually computed (in U space) from 0 to $1/d^{(l)}$, which for certain values of spacing $d^{(l)}$ of receiving-elements 15 may emerge in azimuth and/or elevation within the interval mentioned above ($U_{min}$ to $U_{max}$). In such cases, unfolding the directional signals from at least one PA may be imperative.

The unfolded and/or folded spectra $Z_k^{(l)}$ of one or more of the phased arrays $PA^{(i)}$ may optionally be resampled and/or interpolated in step 65. Resampling and/or interpolation are generally is intended to match the rulers by which spectra from different PAs are provided. Thus, in optional step 65, the folded or unfolded angular frequency spectra (i.e. $Z_k^{(l)}$ or $Z_{k'}^{(l)}$) of some or all of the phased arrays, are resampled and/or interpolated to provide interpolated frequency spectra having common equal size sub-intervals in the region of interest ($[U_{min}, U_{max}]$) for all the phased arrays. Resampling and/or interpolating is intended to match the spectra of different phased arrays $PA^{(i)}$ onto a common ruler having common/similar bins. Indeed, this step may be obviated for frequency spectra ($Z_k^{(l)}$ or $Z_{k'}^{(l)}$) of a certain one or more phased arrays for which the angular frequency sub-intervals (bins) comply with the common equal size sub-intervals.

In this connection, in a transmission configuration/operational mode, the sets of directional signals obtained from the second coherent processing are associated with common angular frequency-bins (e.g. with equal size sub-intervals). In this case, the interpolation of step 65 might be performed in order to obtain in each set $DS^{(i)}$ of directional signals, the frequency bins matching the phased array $PA^{(i)}$ corresponding thereto (e.g. in accordance with the numbers $N^{(i)}$ of the elements in the PA $PA^{(i)}$ and the spacing between the elements).

To this end, a sub-interval of predetermined frequency intervals Δu and an index q are chosen such that common angular frequency bins $U_q$ are calculated for the frequency spectra of all phased arrays. Namely the frequency bins and the index q satisfy:

$$U_q = U_{min} + q * \Delta U \quad \text{Eq. (7)}$$

where the index q satisfies:

$$0 \leq q * \Delta U \leq U_{max} - U_{min}$$

and $U_q$ is closest to the frequency bins ($U_{k'}^{(l)}$ and/or $U_k^{(l)}$) of the frequency spectra of each phased array $L^{l=1,\ldots,L)}$ In determining the frequency bins, common ΔU is chosen for all of the phase arrays (e.g. best matching to the frequency bins of the different phased arrays are determined respectively by their respective angular frequency spacings $\Delta U^{(1)} = 1/d^{(1)}$).

Having determined the common angular frequency bins $U_q$, the complex values of the frequency spectra ($Z_k^{(l)}$ or $Z_{k'}^{(l)}$) of the phased arrays are resampled and interpolated in accordance with the common angular frequency bins $U_q$ to thereby obtain the interpolated frequency spectra $\tilde{Z}_q^{(l)}$ having common bins for all the phased arrays 25.

It is noted that the operations of optional steps 60 and 65 (i.e. unfolding and/or re-sampling and/or interpolating the angular frequency spectra $Z_k^{(l)}$ which are obtained from each respective PA $PA^{(l)}$) may be represented by an interpolation matrix I, which may be a non-squared matrix, as follows:

$$\tilde{Z}_q^{(l)} = I_{q,k}^{(l)} * Z_k^{(l)} \quad \text{Eq. (8)}$$

There are many suitable techniques of complex function interpolation which might be used for carrying out this resampling/interpolation step 65. For example, utilizing zero padding Fourier transform can be performed during step 55. In yet another example, nearest neighbors interpolation algorithms may be carried out to determine the value of $\tilde{Z}_q^{(l)}$ for a specific index q by complex interpolation of the values of $Z_{k'}^{(l)}$ for which indices k' are in the neighborhood of q. Alternatively or additionally, any other suitable method of interpolation may be used according to the invention.

It should be noted here that the operations of steps 55, 60, 65 may be performed in other sequences and/or by other techniques and also that steps 60 and 65 may be optional in some configurations and embodiments of the invention. For example, choosing the zero padding approach, the effect of resampling and interpolation may be inseparable from the integration in step 55.

Following the optional steps 60 and 65 of unfolding and resampling and interpolation of the angular frequency spectra obtained from the different phased arrays 25, the angular frequency spectra $\tilde{Z}_q^{(l)}$ of the phased arrays are obtained within a desired frequency domain $[U_{min}, U_{max}]$) and are indicated by complex values of common angular frequency bins $U_q$. At this stage steps 70 and 75 composite coherent processing (e.g. the second coherent integration/addition) of the frequency spectra from the two or more phased arrays $PA^{(i)}$ is performed. This composite coherent processing is performed with each possible particular direction of propagation $\Theta_k$ (possibly also $\Phi_k$ in 2D case) of a waveform signal S of given wavelength λ to process/determine the phase difference incurred when the waveform signal S is recorded/received by the different phased arrays $PA^{(i)}$ under consideration of the geometrical arrangement of the phased arrays $PA^{(i)}$ (e.g. their relative positions/orientations and spatial disposition between them). To this end, in a digital implementation of the system 1, geometrical data indicative of the geometrical arrangement of the phased arrays $PA^{(i)}$ may be provided to the composite coherent processing module 100 which carries out the composite coherent processing. In an analogue system, the composite coherent processing module 100 may include appropriate phase shifters hardwired in accordance with such geometrical data.

Thus, processing comparable with that of Eq. 9 below is carried out in step 70 to account for such phase shifts of the signal recorded by different phased arrays $PA^{(i)}$. The angular frequency spectra $\tilde{Z}_q^{(l)}$ obtained from the different arrays $PA^{(i)}$ are co-phased to obtain the coherent (co-phased) angular frequency spectrum $Y_q^{(l)}$ for each of the phased arrays $PA^{(i)}$.

$$Y_q^{(l)} = \tilde{Z}_q^{(l)} * e^{-2*\pi*j*U_q*X_l} \equiv H_q^{(l)} * \tilde{Z}_q^{(l)} \quad \text{Eq. (9)}$$

In other words, in this step (70), the angular frequency spectra from different phased-arrays 25 are compensated to correct for discontinuity between phased arrays (to compensate for the dispositions between them). According to some embodiments of the present invention, the disposition between the phased arrays are fixed/constant (e.g. when the differences $X_i - X_{i-1}$ are fixed and not changed in real-time). In such cases, the coefficients $e^{-2*\pi*j*U_q*X_l}$ of the phase-correction for particular directions can be computed in advance to facilitate faster real time processing. In this regard the coefficient of the phase corrections noted as H may be given by the following phase correction matrix H for each of the phased arrays (l index) and each desired directional filter (q index in Eq. (9)):

$$H_q^{(l)} = e^{-2*\pi*j*U_q*X^{(l)}} \quad \text{Eq. (10)}$$

Where $X^{(l)}$ is the position of l-th phase array (e.g. the position of its first element).

Accordingly, the co-phased spectrum $Y_q^{(l)}$ of the signals received from each of the PAs ($PA^{(1)}$-$PA^{(L)}$ in arrangement 25 may be determined by multiplying the signals $\hat{z}n^{(l)}$ sampled from the PAs by a steering matrix S equivalent to the combinations of the operations of one of equations 2 to 4 and optional equation 8 and equation 9 as follows:

$$Y_q^{(l)} = [H_q^{(l)} * I_{q,k}^{(l)} * F_{k,n}^{(l)}] * \hat{z}_n^{(l)} \equiv S_{q,n}^{(l)} * \hat{z}_n^{(l)} \quad \text{Eq. (11)}$$

Note that the matrix $S_{q,n}^{(l)}$ is referred to herein as the steering matrix of the arrangement 25 and for each particular PA index l the sub-matrix $S_q^{(particular\ l)}$, is referred to herein as the steering sub-matrix of the $l^{th}$ phased array. Also note that for PAs not requiring unfolding and/or interpolation, the matrix I may be just a unit matrix.

Thus, the operation of equation 11 may be applied in reception mode for converting the spatially received signals from the arrangement 25 to the angular frequency space (converting them to directional signals/data) and co-phasing the signals from the plurality of PAs. The signals of different PAs are also possibly unfolded to resolve directional ambiguity and are interpolated to common bin values.

It should be understood that in transmission mode the common directional signals/data CDS (indicated in the equation by Y) which are indicative of the direction amplitudes of the waveform that should be transmitted, may be processed utilizing the steering matrix S to determine the actual signals that should be fed to the antenna elements of the plurality of PAs in 25. Specifically, utilizing a given directional data $Y_q$, which indicates the amplitudes of the waveform to be transmitted towards directions indexed by q, the signals $\hat{z}_n^{(l)}$ to be transmitted by each antenna element n of the PAs l may be determined in a manner similar to that shown in Equation 11 above.

During the operation of the system in reception mode, step 75 may also be carried out for completing the second coherent processing by coherent integration (summing/combining) of the coherent frequency spectra Y of all the phased arrays as follows:

$$Y_q = \sum_{l=1}^{L} Y_q^{(l)} \quad \text{Eq. (12)}$$

The coherent frequency spectra $Y_q$ obtained by this coherent integration are actually identical or indicative of the composite directional signals CDS indicated above for example with reference to FIGS. 1A, 1B and 2A. It is noted that this step is not required in transmission mode where integration takes place in the free space. Accordingly, the directional data CDS, which is indicative of the directions and amplitude towards which the signals should be transmitted, is determined commonly for all the PAs (e.g. or for respective subsets thereof). This is implicitly indicated above by omitting the l index from the coherent frequency spectra $Y_q$ which is to be transmitted.

It should be noted that the coherent frequency spectra $Y_q$ obtained in stage 75 is generally equivalent and/or comparable with an angular frequency spectra that would have being obtained by performing Fourier analysis on signals obtained from single larger phased arrays extending the dimensions of the plurality of receiving arrays $PA^{(1)}$ to $PA^{(l)}$ of the invention and including equi-distant receiving elements with their number comparable to the number of receiving-elements 15 in all the receiving arrays $PA^{(1)}$ to $PA^{(l)}$. In this regard, a prominent advantage of the present invention is that it allows to effectively combine the signals received/sensed by multiple separated phased arrays $PA^{(1)}$ to $PA^{(l)}$ and to obtain the accuracy and SNR as would be obtained by a single larger phased-array. This actually allows "distribution"/"division" of a large phased array into multiple array sections which may be placed/arranged on the body/fuselage of a vehicle (e.g. ground- and/or aerial- and/or marine- and/or space-vehicle) on which the larger the phased array cannot be accommodated.

In this regard, it should be understood that the SNR provided by the combined frequency spectra Y may in some cases be better than the SNR of any one single equi-distant phased array of 25. For example, grating lobes in the gain pattern which may appear when utilizing a single phased array of equi-distant spacings may be suppressed by the present invention by utilizing the arrangement 25 including the plurality of phased arrays which may have different distances between their elements and/or may be positioned in arbitrary respective locations and orientations with respect to one another. The coherent integration of Eq. (11) provides enhancement to the intensity of the measured signal in the true directions from which the signals arrive while suppressing the grating-side-lobes/aliasing-effects which may be generated when sampling signals of angular frequencies higher than the Nyquist Frequencies of the phased arrays 25 and unfolding the sampled data. This property of the coherent integration of the present invention is exploited to resolve the ambiguity in angles which may resulted from the grating-side-lobes and thus it allows utilizing phased arrays having wider spacings $d^{(l)}$ between their receiving-elements for resolving the same angular spectral ranges.

In addition, it is understood that the receiving/transceiving system 1 of the present invention is formed by a composite arrangement composed of multiple phased-arrays $PA^{(1)}$ to $PA^{(l)}$ which are spaced apart with spatial dispositions between them. Therefore the spatial extent of the composite arrangement of phased-arrays $PA^{(1)}$ to $PA^{(l)}$ is generally much larger than the spatial extent of any single phased array antenna/receiver formed with a comparable number of receiving elements which are spaced apart with mutual equal spacing comparable to those in the PAs of the invention. Accordingly, since the extent of the two or more phased arrays of the invention may generally substantially be greater than a single comparable PA, it provides/produces substantially narrower beam (better directional resolution) than that which would be produced by a comparable single phased array (phased array antenna).

Since narrower beam suggests better angular resolution, higher accuracy of angular measurement may be obtained (e.g. provided some extra processing is carried out such as for example by carrying out the mono-pulse procedure. In an example of such a mono-pulse procedure, which is based on the composite Δ patterns, the angular spectrum (i.e. provided by the composite directional signals CDS) may be interpolated in order to more accurately locate the peak power position/angle. Additionally, narrowing the beam obtained by the two or more arrays is equivalent to higher gain of the arrangement of phased-arrays $PA^{(1)}$ to $PA^{(l)}$ antenna thus providing the increase in the SNR of the system of the invention as mentioned above.

As noted above, in a transmission configuration/operational mode of the present invention, coherent processing (derivation) of the signals to be transmitted by each of the transceiver arrays $PA^{(i)}$ is performed by carrying out a similar operation of step 70 and then the signals $\hat{z}_n^{(l)}$ resulting from such operation are transmitted simultaneously from a plurality of channels/PAs (e.g. from all the antenna-elements (l,n) or from certain subsets of antenna-elements (l,n) of some of the PAs). It should be understood that in some cases, some of the beams, which are transmitted to one or more certain directions, may be transmitted utilizing only a certain subset of the PAs, while other beams (e.g. transmitted to the same or different directions) may be transmitted by a different subset of the PAs. Thus, according to the present invention, FT matrices F (e.g. DFT matrices) are used together with interpolation and replication (unfolding) matrices I to form independent non-coherent steering matrices corresponding respectively to each of the PAs. Then the independent steering matrices are combined coherently utilizing the phase correction matrix H to form a final coherent steering matrix S corresponding to the arrangement of phased arrays (their positions and orientations) and their respective configurations (the number of elements in each array and the spacing between them). In reception mode the signals from the elements of the PAs are multiplied by the final coherent steering matrix S and are then summed to generate coherent combination of the signals from all the elements which is indicative of the directions/angular frequencies from which one or more incoming waveforms had been received. In transmission, the signals/data indicative of the desired direction/angular-frequency of the signal to be transmitted are multiplied by the coherent steering matrix S to determine the signals to be transmitted by each element. It is noted that according to the present invention, the matrices $S^{(l)}$ and/or any other intermediate matrix used to form these matrices, may be calculated in advance based on the arrangement and configurations of the PAs in arrangement 25, thus further improving the time required for coherent processing of the signals to be transmitted/received by the plurality of antenna elements in the arrangement 25. Turning back to the receiving operation of method 40, at this point the directions from which waveform S is received may be determined from the coherent frequency spectra $Y_q$ (i.e. from the composite directional signals CDS). For example the Directionality processing module 105 is configured according to some embodiments of the present invention to process/compute the absolute value of the combined frequency or the absolute squared value of that spectra $Y_q$ thus giving rise to the response $R_q$ of the arrangement 25 of phased arrays to a waveform signal arriving from directions $U_q$ (e.g. from angles $\theta_q$). $R_q$ can be interpreted as the power of a signal with wavelength $\lambda$ and direction $\Theta_q$ sampled by the receiver-pattern (including the multiple phased arrays 25).

$$R_q=|Y_q|^2 \quad \text{Eq. (13)}$$

is the response to a source from direction corresponding to $$U_q=\cos(\theta_q)/\lambda.$$

Then, the magnitude of the response $R_q$ may be compared with a detection threshold to determine the set of directions (or set of direction indicative parameters/indices-q's) at which an actual signal source (e.g. radar target) is located. Comparing the magnitude of the response $R_q$ with an appropriate threshold allows to filter noise associated responses. For example, the set of directions (q indices) may be determined as follows:

$$q\epsilon\{q's\} \quad \text{Eq. (14)}$$

if and only if $R_q \geq$thresh

According to some embodiments of the present invention the threshold thresh is a predetermined value. Alternatively or additionally, according to some embodiments the threshold thresh may be dynamically determined. For example the value of the threshold thresh may be determined based on a desired false alarm ratio (i.e. a ratio between the number of falsely detected signal sources to the total number of signal sources detection) and misidentification ratio (i.e. a ratio between the number of un-detected signal sources to the total number of signal sources detected). Also dynamic threshold parameters/values may be determined based on processing the received signals to determine certain statistical moments thereof (e.g. average and/or standard deviation) which allow to set threshold properties (e.g. threshold value) discriminating between noise signals and actual signals. The statistical moments may be obtained by processing the received signals in the time and/or space domains.

Thus, given the known wavelength of the signal (this may be known in active radar applications or may be determined by time analysis of the received signals as noted above), the direction of the signal sources at those {q's} (e.g. their $\Theta$ and possibly $\Phi$ angles with respect to the phased arrays) can be devised from $U_q=\sin(\theta_q)/\lambda$.

It should be noted that the last action of calculating the response $R_q$ may be appropriate at this stage only for passive operational modes (e.g. interception of signals by passive radar). For the active modes of radar, the calculation of the response $R_q$ may be postponed until the time domain processing of the received signals is completed, and only then the absolute value of the resultant angular frequency sampled spectra will be taken and squared to produce a response $R_q$ variable which may be compared with the detection threshold. This is because the phase information of each received pulse/signal is required for time domain processing/integration (e.g. coherent pulses integration and/or Doppler processing) which is typically carried out in active radar modes. An example of such time processing of active radar signals which may precede the response calculation is disclosed for example in U.S. Pat. No. 7,864,106 co-assigned to the assignee of the present application.

It should also be understood that the above described processing of method 40 is appropriate for processing narrow band signals, such as radar signals, which are centered around a predetermined frequency (i.e. around wavelength $\lambda$). In other cases, such as in sonar or in some SIGINT applications, which are adapted for receiving wide band signals, the signals should be partitioned/filtered into narrow band sub-signals before they can be processed by the above technique by separately processing the signals received per each narrow band. This is because co-phasing and the coherent integration performed in method steps 50, 55 and 70 above are based on the wavelength of the received signal and may result in incorrect results when processing signals of other wavelengths. Accordingly, wideband signals received from the arrangement 25 of phased arrays should be subs-sectioned/filtered to narrow band frequency sections which are processed separately. Subs-sectioning the signals to one or more narrow bands may be performed by any suitable technique for example by application of digital or analogue band-pass filtering to the received signals.

Turning back to step 50 of method 40, it is noted that in some embodiments, the present invention may be implemented when the phased arrays are not collinearly arranged (or considering the 2D case, coplanarly arranged). In such embodiments, optional step 50 should be employed in order to co-phase the aforementioned the spaced-sampled signals $\hat{z}_n^{(l)}$ on to a common plane. It is noted that this step (50) should be applied on the signals received from only those phased arrays $PAs^{(i)}$ (i.e. certain one or more phased arrays) which do not share a common plane with the rest of the phased arrays in the arrangement 25.

The co-phased signals, which were either sampled from collinear (e.g. coplanar in 2D) phased arrays and/or co-phased in step 50, are noted here by $\hat{z}_n^{(l)}$ (with a caret character) while original samples which are not co-phased are noted hereinafter by $z_n^{(l)}$. Above, the original samples from the phased arrays 25 were considered co-phased.

The process of co-phasing the signals from the different arrays 25 is directed to manipulate the signals received by the phased-arrays such that it appears they have been received by collinear (coplanar) phased arrays 25. The signals from each channel (from each phased array) are appropriately phase shifted to compensate for deviations of the phase arrays from a common plane of interest. As will be further described below, this can be implemented analogically by dedicated phase shifters or by phase shifters which are already a part of the receivers/amplifiers connected to the receiving elements 15.

Turning now back to FIG. 2A, various possible configurations of system 1 in this figure will now be described in more detail. The set of phased array antennas 85 are formed as multiple antenna arrays with spatial discontinuity(ies) (i.e. spatial separations/distances) between them. Each of the phased array antennas 85 includes an array of multiple antenna elements arranged with mutual equal spacing between them along a one or two dimensional surface/line which may be planar or curved. Moreover, the phased array antennas 85 are not necessarily coplanar/collinear with respect to one another (they may not lie on a common plane). Also the mutual equal spacing between antenna elements may be different for different phased array antennas 85 and may also be different for different dimensions of the phased array antenna 85. It is noted that optionally, for some or all of the phased array antennas 85, the equal mutual spacings between the antenna elements may be greater than half of the wavelength of the radiation/signal to be detected thereby. The grating-side-lobes/aliasing-effects may in such cases be suppressed during the processing described above with reference to method steps 60 to 75 (e.g. by the unfolding and second coherent integration of the signals).

The waveform signal/radiation absorbed by phased array antennas 85 is first received by transceivers 90 (e.g. receivers). The transceivers may be suitably implemented for carrying out the invention by utilizing known in the art receiver techniques/structures. The operation of the transceivers 90 is that of conditioning the output signal of the antennas namely to prepare the signals for processing in receiving mode e.g., by applying proper filtering and amplification. In transmission operational mode the transceivers 90 are operated/configured as transmitters and are adapted for conditioning (e.g., amplifying) the low-power desired signal $z_n^{(l)}$, which is to be transmitted, to a high power signal which is then fed to the antennas. Typically, transceivers 90 may include components such as a circulator, a filter, a low noise amplifier, a phase shifter, an attenuator etc. As noted above, the transceivers 90 may include phase shifter utilities which control the beam steering of each of the phased array antennas 85. Phase shifter utilities may include an array of phase shifting modules/elements respectively coupled to the antenna elements of a phased array antenna 85.

In embodiments of the invention, in which some of the phased array antennas 85 are not coplanar/collinear with respect to one another, the signals received/transmitted by the antenna elements of one or more of the phased array antennas 85 are co-phased by the transceivers and thereby aligned onto a common plane (see method step 50 above). In this regard, the phase shifting modules/elements, which are coupled antenna elements of a certain phased array antenna $PA^{(i)}$, are adjusted to shift the phase of the signals received by the antenna elements such as to implement a virtual antenna, the virtual receiving elements of which are virtually aligned on a common desired plane to which other ones of the phased array antenna 85 are aligned.

According to some embodiments of the invention, each pattern builder 95 is configured and operable for obtaining (e.g. by sampling) from its respective receivers 90 signals that are associated with a respective one of the phased array antennas $PA^{(i)}$. The pattern builder 95 may be receiving these signals through its inputs 96 and coherently integrates these signals in accordance with method step 55 above to obtain directional signal portions for each PA. The directional signal portions are then provided through outputs 97.

The composite pattern builder 100 (i.e. composite coherent processing module) is connectable through its inputs 101 (e.g. input ports) to the output ports 97 of the plurality of pattern builders 95. The composite pattern builder 100 is configured and operable to coherently combine the signals received from pattern builders 95 (i.e. in accordance with method steps 70 and 75 above) to form coherently combined signals corresponding to one or more directional beams received by the multiple phase antenna arrays. When coherently combining/adding the output signals from the pattern builders 95 to from a particular directional beam, the spatial separations between the phased array antennas, as well as the spatial directionality of the particular directional beam, are considered. Thus the composite pattern builder 100 is configured and operable to introduce appropriate phase shifts to the input signals received at its inputs 101 and to combine/add such phase corrected signals to generate coherently combined signal(s) at its output 102 (e.g. composite output port).

Optionally, according to some embodiments of the present invention, the processing utility 10 includes an intermediate processing module being for example the interpolation module 98 interconnected/intermediating the output 97 of one or more pattern builders 95 and the inputs 101 of composite pattern builder 100. According to various embodiments of the present invention the intermediate processing module may be configured and operable for unfolding the signals received from the one or more pattern builders 95 and/or for interpolating the signals received from the one or more pattern builders 95. Namely, the intermediate processing module may be configured and operable to perform method steps 60 and/or 65 described above.

Optionally according to some embodiments of the present invention, the processing utility 10 may include directionality processing module 105 operating in the receiving path as a detection/interception module 105 that is configured for receiving, at its input(s), the composite signal outputted from the composite pattern builder 100 and process the composite signal to determine directions from which the actual signal (i.e. which is not a noise signal) is received by the plurality of phased array antennas 85. Actually the detection/interception module 105 analyzes the composite signal to determine for which directions a set of predetermined conditions is fulfilled. For example, the detection/interception module may be configured for carrying out the operations described above with reference to any one of Equations 12 to 14 to obtain the directions at which actual signal-sources/radar-targets exist.

As noted above, various modules of the present invention such as the pattern builder 95, the intermediate/interpolation module 98, the composite pattern builder 100 and/or the directionality processing module 105 may be implemented by analogue and/or digital technologies or by their combinations. Analogue or partially analogue implementations of such modules may be formed by proper arrangement one or more analogue signal processing utilities, such as signal mixers, filters, signal combiners, signal dividers, amplifiers, phase shifters and possibly also A/D samplers. The coherent processing/combination of the various signals as described above may be achieved by applying proper phase shifts to the received analogue signals in order to coherently add and intensify radiation/signals received from particular spatial direction(s) in the inspected space. The signals are phase shifted, split and/or combined by an analogue network of analogue signal processing utilities such as those described above. The network is designed in accordance with the properties and arrangements of the PAs in order to implement the signal processing according to the method 40 above. Various modules of the present invention such as the pattern builder 95, the intermediate/interpolation module 98, the composite pattern builder 100 and/or the directionality processing module 105 may be also implemented digital technologies. In this case, the signals are at some stage sampled (e.g. by receivers 90) to form digital data/signal-samples. These are provided to DSP which is facilitated with proper software and/or hardware to carry out the method 40 above.

Figure 3:
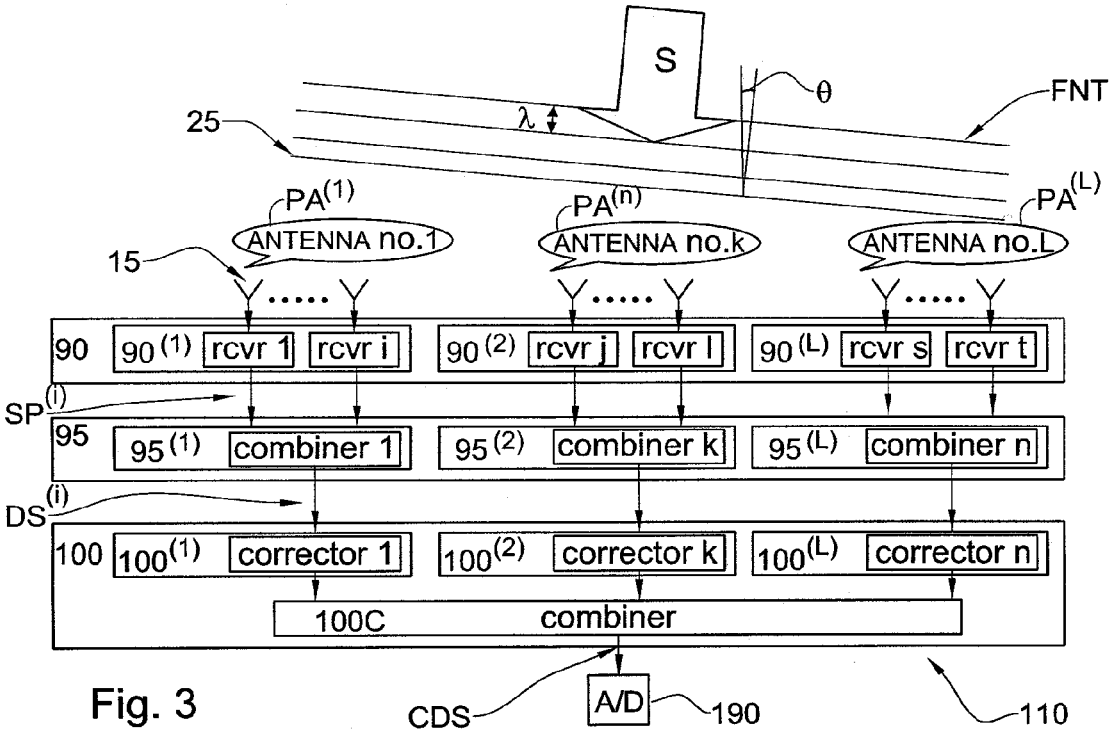
FIG. 3 illustrates schematically a transceiver system according to an embodiment of present invention configured and operable in the reception channels of an analogue system.

Reference is made to FIG. 3 illustrating an embodiment of a transceiver system 1 according to the present invention configured and operable in the reception channels of an analogue system 2, such as a radar system associated with an arrangement 25 of two or more phased arrays $PA^{(i)}$. The transceiver system in this example operates as a receiving channel of the radar system and is adapted for generating a single reception beam (i.e. single angular reception pattern beam) in the receiving channel by coherently combining the signals received by the arrangement 25 of two or more phased arrays $PA^{(i)}$. Specifically, in the present example, the phased arrays $PA^{(i)}$ are implemented utilizing a set of two or more phased array antennas 85. The radar system 2 is an analog system including a sigma receiving channel in the receive path and at least one transmit channel. FIG. 3 illustrates schematically the receive path of such a radar system 2.

In this particular example, phased arrays are implemented by one dimensional (1D) phased array antennas each including an antenna array formed with a plurality of spaced apart antenna elements 15. The phased array antennas $PA^{(1)}$ to $PA^{(I)}$ are considered in this example to be ideally aligned along a certain line X (collinearly aligned). It should be however understood, as will be readily appreciated by those of ordinary skill in the art, that the system of the invention may be also implemented utilizing two dimensional phased array antennas $PA^{(1)}$ to $PA^{(I)}$ which may be aligned in coplanar arrangement. Also, in some cases, some misalignment between phased array antennas $PA^{(1)}$ to $PA^{(I)}$ (e.g. deviations from the X line) are also possible and may be compensated by co-phasing of the signals received by the antennas (see method step 50 above). In the figure, a wavefront FNT of a signal/waveform S with wavelength $\lambda$ is illustrated as it returns towards the phased arrays $PA^{(i)}$ at an angle $\theta$ from a target illuminated by the radar system 2.

Similarly to the system 1 of FIGS. 1 and 2A, in the present example system 1 includes a receiver module 90 connectable to the phased array antennas $PA^{(1)}$ to $PA^{(I)}$ for receiving and processing signals $SP^{(i)}$ indicative of a waveform S received by the antenna elements 15 of the $PAs^{(i)}$. A PAs coherent integration module 95 connectable to the receiving module and adapted to receive the signals $SP^{(i)}$ associated with each of the phased array antennas $PA^{(1)}$ to $PA^{(I)}$ and separately applying thereto a first coherent integration (method step 55 above), thereby determines directional signal portions $DS^{(i)}$ corresponding to each of the phased array antennas $PA^{(1)}$ to $PA^{(I)}$. In this regard it should be noted that in the present example, each of the directional signal portions includes one or more signal portions associated one or more directions corresponding to the single angular reception pattern beam with an angular extent corresponding to the directions from which a returning radar signal is expected. This reduces the amount of signal processing to be applied by the systems and thus simplifies the required system construction and operation. The system 1 also includes a composite coherent processing module 100 that is connectable to the coherent integration module 95 and adapted to perform a second coherent integration on the directional signal portions $DS^{(i)}$ to coherently integrate together corresponding directional signals portions from different phased array antennas $PA^{(i)}$ with appropriate phase-shifts between them and thereby obtain composite directional information (e.g. signals CDS) that are indicative of the signals received by the antennas $PA^{(1)}$ to $PA^{(I)}$ within the desired signal angular reception beam. Namely obtaining data/signals indicative of the amplitudes at which the waveform S, arriving within the reception beam, was received by the antenna arrangement 25.

The receiver module 90 includes multiple receiver utilities (rcvr-i to rcvr-t) which are respectively connectable with each of the receiving elements 15 of the phased array antennas $PA^{(1)}$ to $PA^{(I)}$ (receiver utilities rcvr-i to rcvr-t are depicted in receiver groups $\mathbf{90}^{(1)}$ to $\mathbf{90}^{(I)}$ corresponding to the phased array antennas $PA^{(1)}$ to $PA^{(I)}$ respectively). The receiver utilities rcvr-i to rcvr-t are configured to receive signals indicative of the incoming waveform S received by their respective antenna elements 15 and to apply suitable filtering, amplification and/or down conversion to the received signals. In addition, each receiver group $\mathbf{90}^{(i)}$ is configured and operable to apply appropriate phase shifting and amplitude weightings to the respective signals received thereby from its respective phased array antenna $PA^{(i)}$ for controlling/steering the angular receiving pattern (e.g. beam direction and side lobe level) of its respective phased array antenna $PA^{(i)}$. The phase shifting operation of the receiver groups $\mathbf{90}^{(1)}$ to $\mathbf{90}^{(I)}$ may be controllable/adjustable to steer the angular receiving pattern/beam of the phased array antenna $PA^{(i)}$ corresponding thereto such as to direct the angular receiving pattern/beam towards the same direction $\theta$ from which an incoming signal of interest is expected to be received by the radar system 2. In this regard, it is also noted that in cases where not all of the phased array antennas are co-aligned, the beam steering operation of the receiver groups $\mathbf{90}^{(1)}$ to $\mathbf{90}^{(I)}$ may also be used to compensate for the misalignments (in accordance with method step 50 above).

The output from each of the receiver groups $\mathbf{90}^{(i)}$ is coherently combined by a respective pattern-builder/combiner $\mathbf{95}^{(i)}$ of the PA coherent integration module 95. The actual coherent integration process may be implemented by partial combinations reiterated in multiple stages, by a net of analog combiners (for example a $\log_2(N)$-levels cascade of 2-term summation may be used for summing N terms analogically). It is noted that in this figure a single signal combiner $\mathbf{95}^{(i)}$ is depicted for each phased array antenna $PA^{(i)}$ which is configured to coherently combine the signals from its corresponding phased array antenna $PA^{(i)}$ to produce a single directional signal portion indicative of the amplitude and phase at which signals were received by the antenna $PA^{(i)}$ from a single particular direction.

Upon completion of the first coherent combination process of the signals $SP^{(i)}$ from each phased array $PA^{(i)}$, the corresponding output directional signal $DS^{(i)}$ of each combiner $\mathbf{95}^{(i)}$ is provided to a respective phase corrector module $\mathbf{100}^{(i)}$ of the composite coherent processing module 100. The phase(s) of the directional signal portion $DS^{(i)}$ signal is corrected (e.g. in accordance with step 70 in the method 40 above) so as to compensate for discontinuity between the phased array antennas $PA^{(1)}$ to $PA^{(I)}$. The phase correction is performed for a direction corresponding to the single reception beam from which the radar returned signal is expected (in some cases only a single directional signal portion is of interest from each phased array antenna $PA^{(i)}$). The phase correction is performed per each phased array antenna $PA^{(i)}$ by a corresponding phase corrector module $\mathbf{100}^{(i)}$. As indicated previously, such phase correction can be done analogically by appropriate arrangement of phase shifters. Optionally, the suitable arrangement of attenuators are arranged in series with the aforementioned phase shifters to provide improved control over side lobes in the overall angular pattern of the coherently combined signals from all the phased array antennas $PA^{(1)}$ to $PA^{(I)}$. Specifically, the values of the attenuators may be derived from a single weighing function used for the reception/transmission aperture associated with the entire arrangement 25. Each antenna element may be weighed by appropriate value, corresponding to its location within the entire aperture. The weighting of each antenna-element's signal may be achieved by element-dedicated attenuator (e.g. located in the PA associated with the antenna element, and/or by combination of attenuators), and/or by digital processing). In this regard the attenuator operations are similar to the weighting factors (e.g. $w_n$) noted above in connection with equations 3 or 4. Here, it should be noted that overall angular pattern of the combined beam is effected only when properly attenuating the signals. Its efficiency improves as L, the number of antennas in the set gets bigger since it allows better control over the side lobes. Then the output phase corrected directional signals, as obtained from the phase correctors $\mathbf{100}^{(i)}$, are combined by the signal combiner 100C and are thereby coherently added to obtaining the coherently combined directional signals CDS (combined beam) from all the phased arrays $PA^{(1)}$ to $PA^{(l)}$.

It should be noted that similarly to the configuration and operation of system 1 with respect to the sigma channel of the radar system 2 (as described above), it is also possible to implement system 1 for operating with respect to the delta channels. In this regard, in order to implement the delta channels in a composite system including two or more phase-array antennas $PA^{(1)}$ to $PA^{(l)}$, each phase-array antenna $PA^{(i)}$ is sub-divided into four symmetrical parts. Each symmetrical-part of the phase-array antenna $PA^{(i)}$ is associated with corresponding receiving channel hardware that may be similar to a sigma channel of conventional radar. Also, each set of symmetrical-parts from the two or more phase-array antennas $PA^{(1)}$ to $PA^{(l)}$ is associated with a receiving sub system which is similar to system 1 described above (e.g. with reference to FIG. 3). Namely each subsystem is configured and operable to operate independently for processing the signals received from a set of corresponding symmetrical-parts associated with the two or more phase-array antennas $PA^{(1)}$ to $PA^{(l)}$. Processing is carried out in a manner similar to that described with reference to FIG. 3 to obtain a set of phase corrected directional signals for each set of corresponding symmetrical-parts of the phase-array antennas $PA^{(1)}$ to $PA^{(l)}$. The phase corrected directional signals are then coherently combined and then the composite sigma and delta patterns are generated in 100C with addition of appropriate phasing of all parts. For example, for a sigma channel, the phase corrected signals from all the channels/antenna elements are added; for a delta channel, the phase corrected signals from the channels/antenna-elements are interchangeably multiplied by ±1 to multiply and then summed up.

As indicated above, the system 1 of the present invention may also be configured as a transmitting system (e.g. transceiving system) operable for transmitting signals from the multiple (two or more) phase-array antennas $PA^{(1)}$ to $PA^{(l)}$. Considering FIG. 3 this may be achieved by reversing the direction of the signal flow through the system of FIG. 3 described above and appropriately inverting the functional operation and accordingly the configuration and structure of some of the modules depicted in FIG. 3. For example, in a transmitting architecture, instead of receiver utilities rcvr-i to rcvr-t, high power transmitters are utilized. In the transmitting operation, the combiners $\mathbf{95}^{(1)}$ to $\mathbf{95}^{(l)}$ are configured to carry out the opposite operation and thereby divide functioning as signal dividers and phase shifters for providing signals to the antenna elements 15. The phase correctors $\mathbf{100}^{(1)}$ to $\mathbf{100}^{(l)}$ are configured and operable in the same manner as they are functioning in a receiving channel, thus incurring the same phase shifts to signals processed/transported thereby. The signal combiner 100C is replaced by low power dividers, one per each phased array antenna $PA^{(i)}$. The dividers split the signal to be transmitted to all PA's, after incurring appropriate phase shifts to the signals. In such implementation a single, composite beam is generated and coherently transmitted by the multiple phase-array antennas $PA^{(1)}$ to $PA^{(l)}$.

Turning now to FIG. 4, there is illustrated a receiving system 1 according to another embodiments of the present invention. Here system 1 is configured and operable to generate, in the receive path, an angular receiving pattern that is associated with more than one simultaneous directional receiving beam. The system 1 is configured here somewhat similarly to the system of FIG. 3 but includes the interpolation module 98 adapted to interpolate directional signals obtained by different phased array antennas to generate therefrom directional signals which are indicative of a common set of directions. Specifically, the signal is received by antenna elements 15 of the two or more phased arrays $PA^{(1)}$ to $PA^{(l)}$ and is accordingly processed by the receiver module 90. Then the signals from each phased array antenna $PA^{(i)}$ are coherently combined by a respective pattern-builder/combiners $\mathbf{95}^{(i)}$ of the PA coherent integration module 95 to thereby obtain the set of directional signals $DS^{(i)}$ for each phased array antenna $PA^{(i)}$. Here, there are k directional signals provided by k signal combiners associated with the first phased array $PA^{(1)}$ and s−n+1 directional signals provided by s−n+1 signal combiners associated with the $L^{th}$-phased array $PA^{(L)}$ antenna. The different signal combiners (e.g. combiner-1 to combiner-k) of each certain phased array $PA^{(i)}$ (e.g. signal combiners 1-*k* associated with $PA^{(1)}$) may generally be associated with different subsets of antenna elements of the certain PA $PA^{(i)}$. In the present example, signal combiner combiner-1 is connected to antenna-elements/receiver-utilities Rcvr-1 to Rcvr-30 of PA $PA^{(1)}$, signal combiner combiner-k is connected to antenna-elements/receiver-utilities Rcvr-70 to Rcvr-i of the PA $PA^{(1)}$, and so on. Each of the signal combiners may be configured to coherently combine the signals from the particular subset of antenna elements to which it is connected. To this, each signal combiner may be configured to perform the coherent combination with respect to a certain direction, namely to coherently combine signals which arrive from a certain direction and are received by the antenna elements which are connected thereto such as to produce a combined signal representative of the elemental beam received from that direction. Thus, the plurality of signal combiners are associated with different subsets of antenna elements of the PAs and are operable such that the signals received by each such subset are coherently combined to form a particular directional signal representative of the elemental beams received by the PA from certain directions respectively. Accordingly, a certain set of directional signals (e.g. $DS^{(1)}$) is outputted from the plurality of signal-combiners (e.g. combiners 1-*k*) which are associated with a certain PA (e.g. $PA^{(1)}$).

The set of directional signals $DS^{(i)}$ of a corresponding phased array antenna $PA^{(i)}$ is then processed by respective multi-beam matrix utility $MBM^{(i)}$ of the interpolation module 98. In this regard, as noted above, different sets of directional signals $DS^{(i)}$ (e.g. of different directions) may be obtained by respective pattern-builder/combiners $\mathbf{95}^{(i)}$ of different phased arrays $PA^{(i)}$ (e.g. k directional signals obtained for the first phased array $PA^{(1)}$ and s−n+1 for directional signals provided by the $L^{th}$-phased array $PA^{(L)}$). The multi-beam matrix utility $MBM^{(i)}$ corresponding to each phased array $PA^{(i)}$ is adapted to interpolate the corresponding directional signals $DS^{(i)}$ and to output an interpolated set $DS'^{(i)}$ of directional signals including a predetermined number P of directional signals. The number P of interpolated directional signals of elemental-beams/directions may for example be predetermined in advance and/or it may be determined in accordance with the number of antenna elements in each PA, and/or in accordance with other properties such as the frequency of the signals, spacing/arrangement of the antenna elements. The multi-beam matrix utilities $MBM^{(i)}$ may be implemented as an analogue signal processing network adapted to carry out interpolation operations such as those described for example in method step 65 above and possibly also in method step 60. In this example, all multi-beam matrices provide a similar number of output directional signals P, wherein the number of inputs may vary from one multi-beam matrix $MBM^{(i)}$ to another (i.e. in accordance with the number of signal combiners connected thereto) e.g. which in turn may be set according to the directions that need to be resolved and/or according to the structure/separation and number of receiving antenna elements in the respective phased array antennas $PA^{(i)}$). In this example the number of interpolated directional signals in each of the sets $DS'^{(i)}$ is P and the directional signals in each set includes directional signals indicative of a predetermined set of directions indexed 1 to P, whose set of directions is common for all the interpolated sets $DS'^{(i)}$ and is indicative of the directions of the elemental beams that may be represented by the directional signals in the interpolated sets $DS'^{(i)}$.

Then, in the following, the phases of corresponding directional signals which are obtained from multi-beam matrix utilities $MBM^{(i)}$ of different PAs are adjusted be suitably configured phase-correctors, to compensate for the spatial disposition between the different PAs. Indeed, in order to properly compensate for the phase differences resulting from the dispositions between the antennas, the phase corrections are performed with regard to the directions of the elemental beams represented by the respective directional signals whose phases are compensated. This is achieved by appropriate arrangement of phase corrector modules (e.g. corrector-1 to corrector P+L*P) which are configured to introduce appropriate phase shifts to the signals in accordance with method step 70 above. Specifically in the present example, a phase corrector indexed m+i*P is generally configured to properly compensate the phase of a certain directional signal obtained from the multi-beam matrix utility $MBM^{(i)}$ (i.e. i is the index of the associated PA $PA^{(i)}$) and having direction index m out of the P directions interpolated by the $MBM^{(i)}$.

Finally, all the phase corrected directional signals which correspond to a certain direction (i.e. to the same direction indexes) are coherently combined together to form a composite directional signal (e.g. in accordance with method step 75 above) indicative of the properties of the elemental-beam received by the plurality of PAs from that certain direction. In other words, phase corrected directional signals corresponding to similar directions are coherently combined together to form the composite directional signals CDS indicated above. To this end, signal combiners (e.g. combiner-1 to combiner-P) may be utilized for each one of the required directions which need to be devised by the system 1. Here the index of these signal combiners corresponds to the direction index of the directional signal which they combine from the plurality of interpolated directional signal sets $DS'^{(i)}$. The output composite directional signals CDS may then be digitized by the respective A/D converter and may be further processed (e.g. as described above) to identify radar targets/signals sources.

It should be noted that according to the present invention, a radar system may be provided which is configured and operable with a receiving channel operating similarly to the embodiment of FIG. 4 while its transmitting channel operates to transmit a single wide beam signal. The transmit signal, when returned from one or more radar targets, is received by the receive path (e.g. of FIG. 4) which allows simultaneous processing of received beams in a plurality of directions. Such a radar system configured according to the present invention provides simultaneous coverage of several directions (several received-beams) with improved gain and directional resolution which are obtained via the use of a plurality of PAs to collectively receive the beams while coherently processing the received signals to determine several composite directional signals corresponding to those beams arriving from different directions and collectively received by the plurality of PAs.

To this end, the present embodiment of FIG. 4 may be used as an analog network of such a radar for generating more than one simultaneous elemental beam in the receive path. The signal flows through antennas $PA^{(1)}$-$PA^{(l)}$ and receivers $\mathbf{90}^{(1)}$-$\mathbf{90}^{(l)}$ correspondingly, and is combined by signal combiners (e.g. combiner-1 to combiner-k) of each PA (e.g. $PA^{(i)}$) in accordance with the sub-array structure of the PA to which the respective combiners are connected. The signals from the combiners, continues to the multi-beam matrices ($MBM^{(1)}$ to $MBM^{(L)}$) which each outputs several elemental-beams/directional signals (e.g. P directional signals) and corresponds to a different PA. The number of outputs in this example is P for all multi-beam matrices $MBM^{(1)}$ to $MBM^{(L)}$. The number of inputs to the multi-beam matrices may vary from one multi-beam matrix to another; here it is k for the first PA ($PA^{(1)}$) and s−n+1 for the $l^{th}$ PA ($PA^{(l)}$). In the next step, the phases of the elemental-beams/directional-signals are corrected by the phase correctors 100 (i.e. by corrector 1 to corrector P+L*P) in accordance with the various antennas, and subsequently combined by module 100 (i.e. by Combiner-1 to Combiner-P) per each direction/elemental-beam. Finally combined signals are digitized and may further be processed utilizing various techniques. A possible mode of radar operation here is to transmit a single wide beam which, in the receive path, is covered simultaneously by several receive beams.

Figure 5:
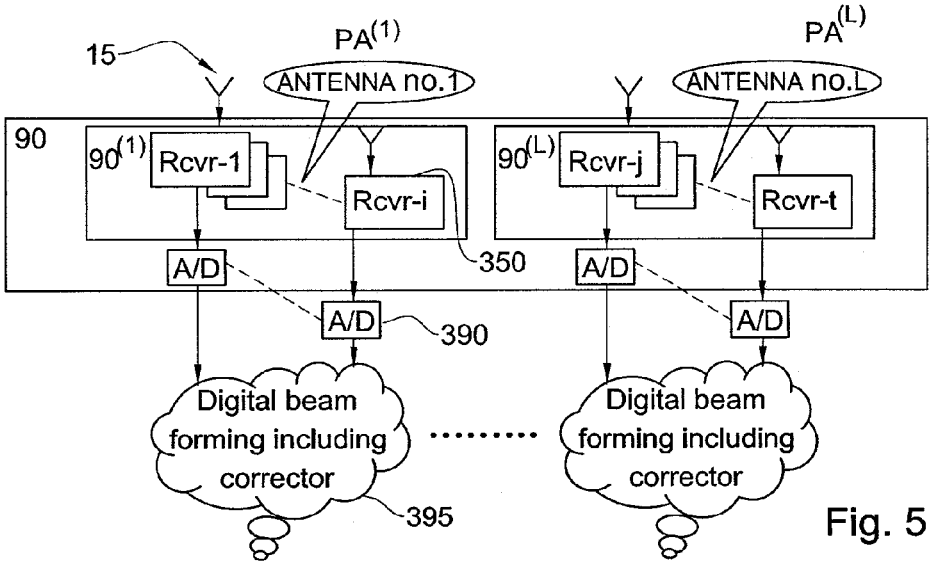
FIG. 5 illustrates schematically a transceiving system (receiving and/or transmitting system) according to an embodiment of the present invention which is configured and operable as a digital system.

Referring to FIG. 5 there is illustrated a transceiving system 1 (receiving and/or transmitting system) according to an embodiment of the present invention which is configured and operable as a digital system implementing the technique of method 40 above (e.g. performing operations indicated by any one or more of equations 11 to 15) for detecting and processing received signals and also configured and operable for carrying out the inverse of the method 40 for determining signals to be transmitted for generating desired waveforms propagating towards particular directions. Here, two or more of the phased array antennas $PA^{(1)}$ to $PA^{(l)}$ are provided, associated with multiple antenna elements 15. The phased array antennas are associated with a receiving module 90 configured such that each individual antenna element 15 is associated with a receiver utility including receiver-circuitry 350 and a digitizer (A/D converter) 390. The digitizer 390 is configured to carry out sampling in step 45 of method 40 above. Other functional elements of the system 1 as described above with respect to FIG. 1A (e.g. the PAs coherent integration module 95, the composite coherent processing module 100 and possibly also the interpolation module 98) are implemented by a suitable digital signal processing system (i.e. DSP; e.g. computer system) in conjunction with appropriate executable programmatic instructions operable in accordance with method 40. Specifically the DSP is configured and operable to receive the digital signals from the digitizers 390 and process them in accordance with method steps 50 to 75 above. The programmatic instructions implementing the method of the invention and specifically implementing modules 95, 98 and 100, and possibly additional modules such as 105 above, may be implemented by a computer readable code embedded in a computer readable medium.

Figure 6A:
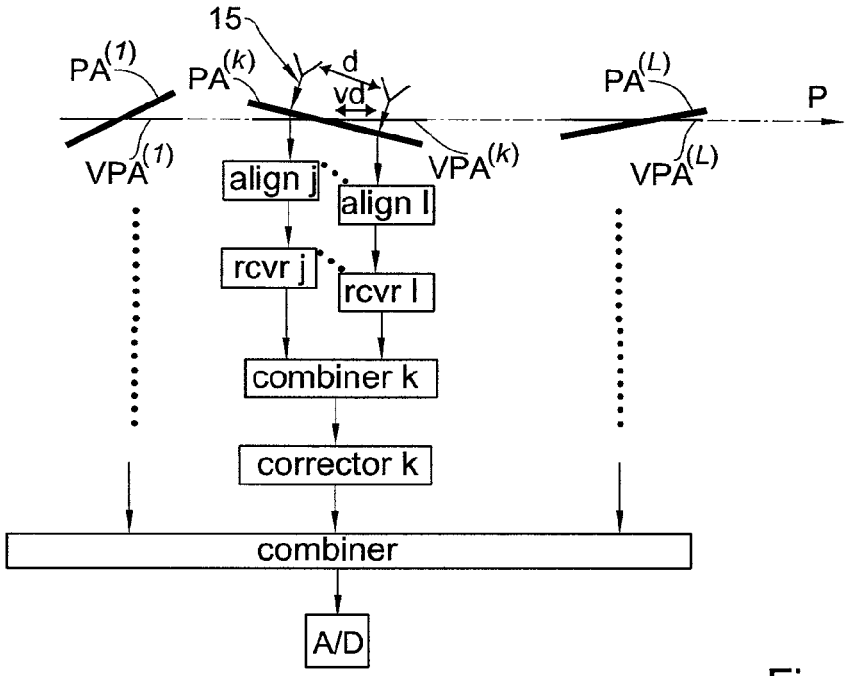
FIGS. 6A and 6B illustrate schematically two embodiments of a transceiving system according to the present invention in which the antenna elements of the phased array antennas are not aligned on a common axis/plane.
Figure 6B:
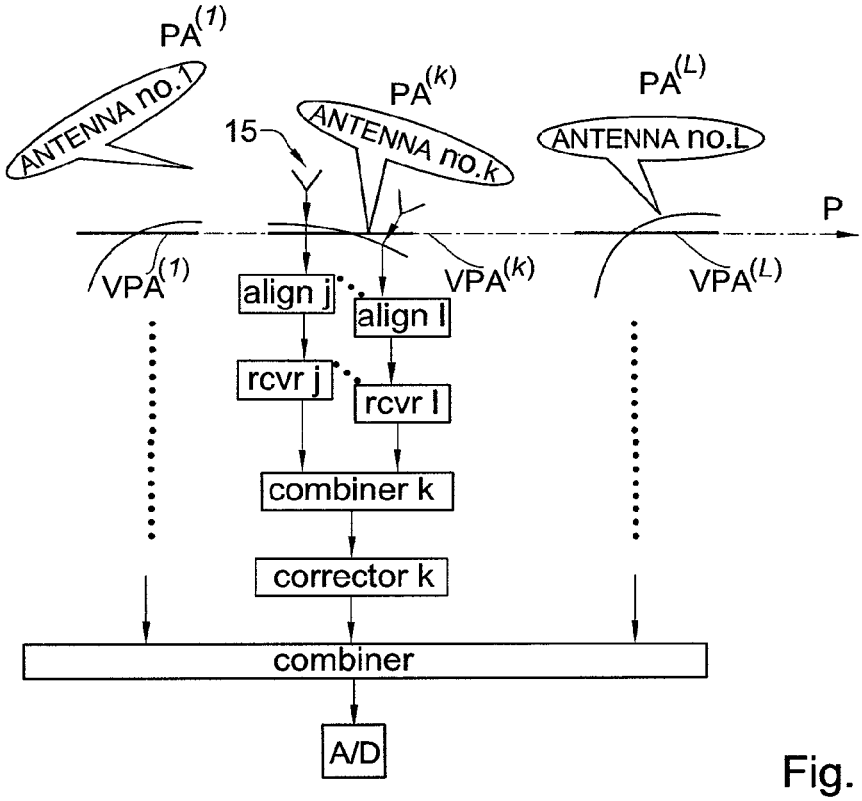

Reference is made together to FIGS. 6A and 6B illustrating two examples of the system 1 according to the present invention in which the phased array antennas $PA^{(i)}$ are not aligned on a common axis/plane (e.g. not perfectly aligned FIG. 6A) and/or are not planar phased arrays (FIG. 6B). Misalignment between the phased array antennas $PA^{(i)}$ as in FIG. 6A and/or between individual receiving elements 15 in these antennas (FIG. 6B) is compensated by appropriate co-phasing applied to the signals received from the receiving elements 15 of the phased array antennas $PA^{(i)}$. This is implemented in this embodiment by the phase aligners align-j to align-i illustrated in the figure as part of the receiving module 90.

In this example, the embodiment of FIGS. 6A and 6B are actually similar to the system of FIG. 3 except for the misalignment between the antennas. However, it is noted that the principles of co-phasing described in these embodiments are also applicable for any other embodiment of the system of the present invention.

In order to compensate for the misalignment between the antennas, the phases of signals received from the antenna elements 15 are adjusted to co-phase signals from the elements 15 of phased arrays antennas $PA^{(1)}$ to $PA^{(l)}$ as if those elements 15 are on a common line (plane) P. Such co-phasing provides a perfect alignment of virtual antennas, 1 to L, on that common line (plane) P.

For example, considering $\bar{x}_n^{(l)}$ signifies the position vector of the element n of array l and $\bar{y}_n^{(l)}$ signifies the projection of the array onto a preferred plane (i.e. the projection of the position vector $\bar{x}_n^{(l)}$ on the preferred plane), then the projection matrix P, projecting of the array l on the preferred plane, may be written as follows:

$$P_{k,n}^{(l)}=e^{i\bar{k}\cdot(\bar{x}_n^{(l)}-\bar{y}_n^{(l)})}$$

where k is the angular frequency of a particular signal of certain frequency λ propagating in certain direction (unit vector) $\hat{r}$ and is given by $$\bar{k}=\frac{2\pi}{\lambda}\hat{r}.$$

In this regard it is noted that the different projections are calculated for different angular frequencies. According to various embodiments of the present invention one or more projection matrices for one or more different angular directions may be implemented utilizing analog or digital signal processing techniques.

It should be noted that according to some embodiments of the present invention non-coplanar arrays (PAs) are utilized. For example a plurality of PAs may be arranged at different locations and/or orientations on a vessel/platform such as a ship, airplane or other platform. In this regard, a projection matrix $P_{k,n}^{(l)}$ may be employed for projecting the signals of different PAs by co-phasing them with respect to a certain common "virtual"/reference plane. In this connection according to some embodiments, a single projection matrix $P_{k,n}^{(l)}$ may be used for the whole scan range/steering sector. For example narrowband applications, such as radar, can tolerate that for each PA (index l) a single projection matrix $P_{k,n}^{(l)}$ is used for the entire angular steering sector wherein the selected correction may for example correspond to the broadband direction and the middle of the bandwidth. The resulting distorted beams at squint angles may be tolerable for e.g. scan range typical of narrowband phased array radars. Alternatively, or additionally, according to some embodiments, a dedicated projection matrix $P_{k,n}^{(l)}$ may be formed/used for each particular direction or sector (angular region) of interest (e.g. for each particular angular frequency k) for which signal processing is desired.

To this end, the matrix $F_{k,n}^{(l)}$ (referred to above with respect to Eq. 2 and 4 as the of Fourier Transform of $PA^{(1)}$), may be given as a multiplication of an actual Fourier Transform matrix $F'_{k,n}^{(l)}$ on the virtual $PA^{(1)}$ and the projection matrix $P_{k,n}^{(l)}$, as follows: $F_{k,n}^{(l)}=e^{i\bar{k}\bar{x}_n^{(l)}}=e^{i\bar{k}\bar{y}_n^{(l)}}e^{i\bar{k}\cdot(\bar{x}_n^{(l)}-\bar{y}_n^{(l)})}=F'_{k,n}^{(l)}P_{k,n}^{(l)}$. In case the PAs are aligned on a common plane/axis (e.g. reference plane), the projection matrix P is a unit matrix. For PAs not aligned on that common plane/axis, the signals are projected on the common/reference plane/axis by the projection matrix P (which are not unity matrixes for such PAs) so that Fourier transform may be calculated with respect to the reference plane (e.g. as if those signals are received/transmitted by a virtual PA laying on the reference plane and the FT (steering) coefficients are calculated for the Virtual PA). Thus, the steering matrix S of equation 11 above may be defined including the projection matrix used to co-phase the signals from the non-coplanar/collinear PAs. Specifically, equation 11 can be rewritten as:

$$Y_q^{(l)}=[H_q^{(l)}*I_{q,k}^{(l)}*F_{k,n}^{(l)}]*\hat{z}_n^{(l)}=[H_q^{(l)}*I_{q,k}^{(l)}*F'_{k,n}^{(l)}*P_{k,n}^{(l)}]*\hat{z}_n^{(l)}\equiv S_{q,n}^{(l)}*z_n^{(l)} \quad \text{Eq. (15)}$$

Here $\hat{z}_n^{(l)}$ and $z_n^{(l)}$ are respectively the non-co-phased and co-phased signals received/transmitted by the arrangement of PAs ($\hat{z}_n^{(l)}$ is defined for the actual/real PAs and $z_n^{(l)}$ defined for the virtual PAs positioned along the common reference plane. These are related by the projection matrix as $\hat{z}_n^{(l)}=P_{k,n}^{(l)}*z_n^{(l)}$. As noted above in various implementations of the present invention, similar or different phase correction factors (projection matrices P) may be used for receiving/transmitting waveform in different directions by utilizing the non-coplanar arrays or by utilizing the curved arrays.

In this connection it should be noted that the process of alignment/co-phasing the signals affects the effective spacing/separation between the receiving elements with respect to the plane P. Specifically co-phasing modifies the signals from the receiving elements of a certain phased array antenna $PA^{(i)}$ of certain fixed spacing d between its receiving elements 15 as if they were received from a virtual phased array antenna $VPA^{(i)}$ which is aligned on the line/plane P but has different spacings vd between its receiving elements. Accordingly, the angular steering of the reception beam pattern from co-phased signals associated with the "virtual" antenna $VPA^{(i)}$ is implemented considering the virtual spacing vd between the antenna virtual antenna elements. This however does not require any additional operations/method-steps since the technique of the present invention, as described above (e.g. in method 40) is adapted for processing signals received from multiple phased array antennas which may possible have different spacings between their antenna elements (specifically the different spacings may be compensated by the operation of methods steps 65 and/or 65 above).

The phase aligners align-j to align-i illustrated herein may be in fact implemented by a set of appropriately adjusted phase shifters of the receiver module 90. Specifically, as noted with reference to FIG. 3, receiver module 90 may include a set of phase shifting modules (which may be fixed or adjustable/controllable) which it used for steering the direction and angular extent of the reception beam. In this connection the same phase shifters may also be utilized in the present example for compensating the misalignment between the phased array antennas or their elements (e.g. by steering the reception beam of the different phased array antenna to counteract the misalignment between the antennas). Additionally, in series with the process of co-phasing by the phase aligners, the receivers module 90 may also be configured and operable to apply amplitude weighting to the signals received from the antenna elements 15 in order to compensate for some amplitude attenuation which may be inherently affected by the signal and by the phase aligners, and in order to control the side lobe level of the angular pattern at the desired level.

With respect to FIG. 6B it should be further noted that here the co-phasing procedure may be conceptually subdivided into two stages:

i. the signaled received by the receiving elements of each curved phased array antenna $PA^{(i)}$ are phase shifted and (e.g. first conceptual co-phasing stage) to emulate a virtual planar antenna which is, for example, tangential to the curve of the $PA^{(i)}$ at its point of symmetry; then ii. the signals of each such virtual tangential planar antenna are phase shifted (e.g. second conceptual co-phasing stage) to emulate the signals received by a virtual antenna laying on a common plane/line P with the rest of the phased array antennas $PA^{(i)}$.

In this regard it is understood that the first and second conceptual co-phasing stages may be implemented together utilizing a single phase shifting element/utility for each antenna element whose signal is to be phase shifted.

Thus the present invention provides a technique (system and method) for implementing a composite receiver/transmitter module including a plurality of arrays of transmitting/receiving elements. Specifically the receiver/transmitter module may be for example a composite antenna module including a plurality of phased array antenna modules. The invention also provides a method for coherently processing the signals to be transmitted/received by the composite receiver/transmitter. The coherent processing technique of the present invention may be used with 1D or 2D phased array antenna modules which may also be curved or misaligned with respect to one another. In this connection, the system of the invention may be suitably mounted on various platforms which might be associated limited place for accommodating a single continuous array of receivers/transmitters. In such cases (e.g. for moving platforms such as aerial-platforms/airplanes, marine-platforms/ships and terrestrial-platforms/vehicles/tanks) the invention allows use of a plurality of spaced apart smaller receiver/transmitter arrays arranged in a spatial disposition on the moving platform. The signals from such a plurality of spaced apart receiver/transmitter arrays are coherently processed to form a composite coherent signal with accuracy and SNR similar or better than that of a comparable single larger receiver/transmitter array. In this regard the plurality (two or more) of receiver/transmitter arrays may include co-aligned planar (linear) antenna arrays and/or non-aligned planar (linear) antenna arrays and/or curved antenna arrays which may be co-aligned or not. This facilitates accommodating such a plurality of arrays on an optionally curved body of the moving platform.

Also, the processing technique of the invention may be implemented by analogue signal processing means and/or by digital signals processing means and/or by their combinations as specifically exemplified above. Additionally, the system according to various embodiments of the present invention may be configured and operable for use/integration with active/passive radar systems and/or it may be adapted for interception of waveform signals of unknown sources e.g. in a surveillance space. In this regard in various embodiments of the invention described above the system of the invention is utilized to form composite sigma and delta channels of a radar system adapted for receiving signals from a plurality of phased array antennas.

It is noted that the coherent processing technique which is described herein, in the scope of the present invention, for coherently combining signals from/to multiple receivers/transmitters arrays (form multiple phased array antennas) provides various improvements to the properties of a received/transmitted signal as compared with other techniques in which the signals are not coherently combined. Specifically, the technique of the invention provides one or more of the following improvements: enhancement to the signal's SNR and/or gain/power, improving directional resolution and improving directional accuracy, resolving ambiguity from signals received by different types of phased arrays antennas, and more.

The invention claimed is:

1. A method for receiving and/or transmitting waveforms by two or more phased arrays, the method comprising:

i. applying a first coherent processing to two or more signal sets comprising signal portions being received or transmitted by corresponding two or more phased arrays (PAs) operating in respective receiving or transmitting modes, wherein said first coherent processing comprises converting the sets of signal portions being received into corresponding sets of directional signals or converting sets of directional signals into the sets of signal portions to be transmitted, said converting comprising coherent integrations of each set in one of the sets of signals portions or the sets of directional signals for obtaining the other one of said sets of signals portions and said sets of directional signals; each of the directional signals being indicative of the angular frequencies, amplitudes and phases of waveforms to be received or transmitted; and ii. applying a second coherent processing to a coherent set of directional signals or to said two or more sets of the directional signals to perform the respective transmitting and receiving modes, wherein said second coherent processing of the transmitting and receiving modes comprises adjusting phases of respectively said coherent set of directional signals and said sets of the directional signals, the phase being adjusted in accordance with spatial dispositions between the PAs and the angular frequencies of the directional signals, the phase adjusting in the transmitting and receiving modes providing respectively the sets of the directional signals and the coherent set of directional signals, thereby enabling to utilize said two or more PAs to carry out at least one of coherently receiving and coherently transmitting with improved gain of one or more waveforms propagating in one or more directions.

2. The method according to claim 1 configured for operating in receiving mode for determining one or more directions of propagation of an incoming waveform received by said arrangement of two or more PAs;

the method comprising simultaneously receiving incoming waveform by said two or more PAs and generating two or more sets of signal portions corresponding to said incoming waveform respectively received by said two or more phased arrays PAs; and said first coherent processing comprising applying coherent integration to each of the two or more sets of signal portions for a given wavelength to obtain the two or more corresponding sets of directional signals;

said second coherent processing comprising adjusting the phases of the directional signals in said sets of directional signals in order to correct said phases by compensating over the spatial dispositions between the PAs thereby determining two or more phase adjusted sets of directional signals corresponding to said two or more PAs, and coherently adding corresponding directional signals which are associated with similar angular frequencies in said two or more phase adjusted sets of directional signals thereby determining one or more composite directional signals presenting said coherent set of directional signals, wherein each composite directional signal being indicative of an amplitude by which an incoming waveform with a particular angular frequency was received by the two or more PAs;

thereby enabling to utilize said two or more PAs to determine one or more directions of propagation of said incoming waveform with improved signal to noise ratio and improved angular resolution.

3. The method according to claim 1 configured for operating in transmitting mode for determining two or more sets of signal portions to be transmitted respectively by the elements of said two or more PAs for generating transmitted waveform propagating in one or more desired directions; the method comprising:

providing said coherent set of directional signals in which each directional signal being indicative of an amplitude and particular direction towards which a waveform signal should be transmitted by said two or more PAs; and said second coherent processing comprising applying phase adjustment to directional signals in two or more replicas of said coherent set of directional for respectively generating said two or more sets of directional signals from said two or more replicas, wherein said phase adjustment is adapted to correct the phases of the directional signals of each particular set of directional signals in accordance with spatial disposition of the PA respectively associated with the particular set of directional signals; and said first coherent processing comprising applying coherent integration to each of the two or more sets of directional signals for respectively generating, for a given transmission wavelength, the two or more sets of signal portions and simultaneously providing said sets of signals portions to the elements of the respective PAs for transmitting said transmitted waveform towards said one or more desired directions of propagation with improved angular resolution and reduced sidelobes.

4. The method according to claim 2, further comprising comparing powers said composite directional signals with a predetermined criteria to determine, for at least one composite directional signal, whether it is indicative of an actual incoming waveform propagating from a particular direction corresponding to the angular frequency thereof or whether it is noise signal.

5. The method according to claim 1 wherein one or more of said PAs are configured as curved PAs, each including an array of elements arranged along a curved surface or line.

6. The method according to claim 1 wherein the elements of at least one PA are arranged in uniform spatial disposition defining fixed distances between them with respect to at least one axis; wherein at least one of the following:

said elements are arranged on said axis with said fixed distances between them; or at least some of the elements are spaced from said axis and said fixed distance being the distance between projections of said at least some elements onto said axis.

7. The method according to claim 6 wherein the fixed distance between the elements of at least one PA of said two or more PAs is different from a fixed distance between the elements of other PA of said two or more PAs, such that the sets of directional signals associated with said at least one PA and said other PA include signals from different groups of angular frequency bins; the method comprising interpolation of directional signals carried out in at least one of the following: (i) in receiving operational mode, said interpolation includes interpolating at least one set of the two or more sets of directional signals to thereby obtain, in said two or more sets of directional signals, directional signals indicative of the amplitudes and phases with respect to a common group of angular frequency bins with improved directional resolution; or (ii) in transmitting operational mode, said interpolation includes interpolating at least one set of two or more sets of directional signals, which are associated with a common group of angular frequency bins as resulted from said second coherent processing, to thereby obtain, the sets of directional signals which are associated with different groups of angular frequency bins set in accordance with the fixed distance between the elements of their respective PAs.

8. The method according to claim 7 wherein said first coherent processing and said interpolation are performed together utilizing a zero-padding fast-Fourier-transform algorithm.

9. The method according to claim 7 wherein interpolation of at least one set of directional signals comprises resampling the directional signals of said at least one set.

10. The method according to claim 6, wherein the fixed distances of said uniform spatial disposition between the elements of at least one PAs of said two or more PAs are greater than half said given wavelength thereby proving that at least one set of directional signals, which corresponds to said at least one PA and involved in said first coherent processing, is a folded set associated with directional ambiguity; the method comprising converting between said folded set and an unfolded set of directional signals, which is expressly indicative of said directional ambiguity, and utilizing said unfolded set of directional signals in said second coherent processing.

11. The method according to claim 1 wherein at least one PA of said the two or more PAs is not aligned with other PAs of said two or more PAs; the method comprising modifying at least one set of signal portions corresponding to said least one PA by co-phasing the signal portions of said at least one set of signal portions to compensate for misalignment between said at least one PA and said other PAs.

12. The method according to claim 1 wherein said first coherent processing is performed by applying a Fourier transform or an inverse thereof, based on said given wavelength, to convert between said two or more sets of signal portions and the two or more corresponding sets of directional signals.

13. The method according to claim 1 wherein in said second coherent processing, the phase of a directional signal associated with a particular PA is shifted by an amount corresponding to the phase delays incurred to a waveforms signal, which is received by said PA with an angular frequency indicated by said directional signal, due to disposition between said particular PA and other PAs.

14. A computer program product comprising a non-transitory computer readable medium having computer readable program code embodied therein and adapted for causing the computer to carry out the method of claim 1.

15. A system for receiving and/or transmitting waveforms by two or more phased arrays, the system comprising a signal processing utility connectable to the elements of two or more PAs and configured for operating in at least one of receiving and transmitting modes for applying signal processing to signals respectively received or transmitted by the elements of said two or more PAs said signal processing comprising:

i. applying a first coherent processing to two or more signal sets comprising signal portions being received or transmitted by corresponding two or more phased arrays operating in respective receiving or transmitting modes, wherein said first coherent processing comprises converting the sets of signal portions being received into corresponding sets of directional signals or converting sets of directional signals into the sets of signal portions to be transmitted, said converting comprising coherent integrations of each set in one of the sets of signals portions or the sets of directional signals for obtaining the other one of said sets of signals portions and said sets of directional signals; each of the directional signals being indicative of the angular frequencies, amplitudes and phases of waveforms to be received or transmitted; and ii. applying a second coherent processing to a coherent set of directional signals or to said two or more sets of the directional signals to perform the respective transmitting and receiving modes, wherein said second coherent processing of the transmitting and receiving modes comprises adjusting phases of respectively said coherent set of directional signals and said sets of the directional signals, the phase being adjusted in accordance with spatial dispositions between the PAs and the angular frequencies of the directional signals, the phase adjusting in the transmitting and receiving modes providing respectively the sets of the directional signals and the coherent set of directional signals, the system thereby provides for utilizing said two or more PAs to carry out at least one of coherently receiving and coherently transmitting one or more waveforms propagating in one or more directions.

16. The system according to claim 15 configured for operating in receiving mode for determining one or more directions of propagation of an incoming waveform received by said arrangement of two or more PAs, wherein said processing utility is adapted to receive said two or more sets of signal portions of incoming signals, simultaneously received by said two or more PAs respectively;

the system comprises a PA coherent processing module adapted to carry out said first coherent processing by applying a first coherent integration to each of the two or more sets of signal portions based on a given wavelength to thereby obtain two or more corresponding sets of directional signals; and the system comprises a composite coherent processing module adapted for applying said second coherent processing to the two or more sets of the directional signals wherein said second coherent processing comprising adjusts the phases of the directional signals in said sets of directional signals in order to correct said phases by compensating over the spatial dispositions between the PAs and thereby determining two or more phase adjusted sets of directional signals corresponding to said two or more PAs, and coherently adding one or more corresponding directional signals which are associated with similar angular frequencies in said two or more phase adjusted sets of directional signals thereby determining one or more composite directional signals presenting said coherent set of directional signals, wherein each composite directional signal is indicative of an amplitude by which an incoming waveform with a particular angular frequency was received by the two or more PAs;

the system thereby provides for determining one or more directions of propagation of said incoming waveform with improved signal to noise ratio and improved angular frequency resolution.

17. The system according to claim 15 configured for operating in transmitting mode for determining two or more sets of signal portions to be respectively transmitted by the elements of said two or more PAs for generating transmitted waveform signals propagating in one or more desired directions; wherein said processing utility is adapted to obtain said coherent set of directional signals in which each signal being indicative of an amplitude and particular direction towards which a waveform signal should be transmitted by said two or more PAs; and the system comprises a composite coherent processing module adapted for carrying out said second coherent processing by applying phase adjustment to directional signals in two or more replicas of said coherent set of directional signals for respectively generating said two or more sets of directional signals from said two or more replicas, wherein said phase adjustment is adapted to correct the phases of the directional signals of each particular set of directional signals in accordance with spatial disposition of the PA respectively associated with the particular set of directional signals; and the system comprises a PA coherent processing module adapted for carrying out said first coherent processing by applying coherent integration to each of the two or more sets of directional signals for respectively generating, for a given transmission wavelength, the two or more sets of signal portions;

the processing utility is adapted to simultaneously provide said sets of signal portions to the elements of the respective PAs for causing transmission of said waveform signals towards said one or more desired directions of propagation with improved angular resolution and reduced sidelobes.

18. The system according to claim 16 wherein said coherent processing module is further adapted for further comparing powers of said composite directional signals with a predetermined criteria to determine, for at least one composite directional signal whether it is indicative of an actual incoming waveform propagating from a particular direction corresponding to the angular frequency of the directional signal or whether it is a noise signal.

19. The system according to claim 15, further comprising said two or more PAs; and wherein at least one of the following:

one or more of said PAs are configured as curved PAs, each including an array of elements arranged along a curved surface or line; and at least one PA is associated with a uniform spatial disposition of its elements, said uniform spatial disposition being defined by a fixed distance between the elements along at least one axis, such that said elements are arranged in one or more of the following ways:

i) the elements are arranged on said axis with said fixed distances between them; or ii) at least some of the elements are spaced from said axis and said fixed distance being the distance between projections of said at least some elements onto said axis.

20. The system according to claim 19 wherein said two or more PAs are configured such that distance between the elements of at least one PA of said two or more PAs is fixed and is different from a fixed distance between the elements of the other PA of said two or more PAs, such that the sets of directional signals are associated with different groups of angular frequency bins; and wherein the processing utility is operable for interpolating directional signals by carrying out at least one of the following: (i) in receiving operational mode, interpolating at least one set of the two or more sets of directional signals to thereby obtain, in said two or more sets of directional signals, directional signals indicative of the amplitudes and phases with respect to a common group of angular frequency bins with improved directional resolution; or (ii) in transmitting operational mode, interpolating at least one set of two or more sets of directional signals, which are associated with a common group of angular frequency bins resulting from said second coherent processing, to thereby obtain the sets of directional signals which are associated with different groups of angular frequency bins set in accordance with the fixed distance between the elements of their respective PAs.

21. The system according to claim 15, wherein at least one PA of said two or more PAs is configured with a fixed distance between its elements which is greater than half said given wavelength, thereby providing that at least one set of directional signals, which corresponds to said at least one PA and involved in said first coherent processing, is a folded set of directional signals associated with directional ambiguity; the processing utility is adapted for converting between said folded set and an unfolded set expressly indicative of said directional ambiguity; and said composite coherent processing module is adapted for utilizing said unfolded set in said second coherent processing thereby resolving said directional ambiguity.

22. The system according to claim 15 wherein at least one PA of said the two or more PAs is not aligned with other PAs of said two or more PAs; the processing utility comprising a phase alignment module that is configured and operable for modifying at least one set of signal portions corresponding to said least one PA by co-phasing the signal portions of said at least one set of signal portions to compensate for misalignment between said at least one PA and said other PAs.

23. The system according to claim 22 wherein said at least one PA is at least one of a two dimensional PA not coplanarly aligned with said other PAs, a one dimensional PA not collinearly aligned with said other PAs, and a curved PA; and wherein said phase alignment module is configured and operable for respectively compensating over a corresponding one of a coplanar- and collinear-misalignment and a curvature of said at least one PA.

24. The system according to claim 15 wherein in said second coherent processing, the phase of a directional signal associated with particular PA is shifted by an amount corresponding to the phase delays, which are incurred to a waveform, received or transmitted by said particular PA and having an angular frequency indicated by said directional signal, due to disposition between said particular PA and other PAs.

* * * * *